US012017327B2

(12) United States Patent
Nienaber et al.

(10) Patent No.: US 12,017,327 B2
(45) Date of Patent: Jun. 25, 2024

(54) PARTICLE RECEPTION IN ABRASIVE ARTICLE CREATION

(71) Applicant: 3M INNOVATIVE PROPERTIES COMPANY, St. Paul, MN (US)

(72) Inventors: Aaron K. Nienaber, Lake Elmo, MN (US); Joseph B. Eckel, Vadnais Heights, MN (US); Thomas J. Nelson, Woodbury, MN (US); Ann M. Hawkins, Lake Elmo, MN (US); Amelia W. Koenig, Minneapolis, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 202 days.

(21) Appl. No.: 17/415,135

(22) PCT Filed: Dec. 10, 2019

(86) PCT No.: PCT/IB2019/060627
§ 371 (c)(1),
(2) Date: Jun. 17, 2021

(87) PCT Pub. No.: WO2020/128720
PCT Pub. Date: Jun. 25, 2020

(65) Prior Publication Data

US 2022/0055186 A1 Feb. 24, 2022

Related U.S. Application Data

(60) Provisional application No. 62/781,057, filed on Dec. 18, 2018.

(51) Int. Cl.
*B24D 11/00* (2006.01)
*B24D 18/00* (2006.01)

(52) U.S. Cl.
CPC ..... *B24D 11/001* (2013.01); *B24D 18/0072* (2013.01); *B24D 2203/00* (2013.01)

(58) Field of Classification Search
CPC ..... B24D 11/001; B24D 18/0072; B24D 2203/00
USPC ..... 51/293, 297
See application file for complete search history.

(56) References Cited

U.S. PATENT DOCUMENTS

| | | | |
|---|---|---|---|
| 1,910,444 | A | 5/1933 | Nicholson |
| 2,141,658 | A | 12/1938 | Melton |
| 3,041,156 | A | 6/1962 | Rowse |
| 3,058,819 | A | 10/1962 | Paulson |
| 3,616,580 | A | 11/1971 | Dewell |
| 3,676,092 | A | 7/1972 | Buell |
| 3,729,873 | A | 5/1973 | Sandell |
| 3,784,365 | A | 1/1974 | Caserta |
| 3,833,346 | A | 9/1974 | Wirth |
| 3,868,232 | A | 2/1975 | Sioui |
| 3,869,834 | A | 3/1975 | Mullin |
| 4,215,516 | A | 8/1980 | Huschle |
| 4,314,827 | A | 2/1982 | Leitheiser |
| 4,475,926 | A | 10/1984 | Hickory |
| 4,623,364 | A | 11/1986 | Cottringer |
| 4,652,275 | A | 3/1987 | Bloecher |
| 4,734,104 | A | 3/1988 | Broberg |
| 4,737,163 | A | 4/1988 | Larkey |
| 4,744,802 | A | 5/1988 | Schwabel |
| 4,751,138 | A | 6/1988 | Tumey |
| 4,770,671 | A | 9/1988 | Monroe |
| 4,799,939 | A | 1/1989 | Bloecher |
| 4,881,951 | A | 11/1989 | Wood |
| 4,997,461 | A | 3/1991 | Markhoff-Matheny |
| 5,009,675 | A | 4/1991 | Kunz |
| 5,011,508 | A | 4/1991 | Wald |
| 5,042,991 | A | 8/1991 | Kunz |

(Continued)

FOREIGN PATENT DOCUMENTS

| | | |
|---|---|---|
| EP | 1207015 | 5/2002 |
| EP | 3086903 | 7/2015 |

(Continued)

OTHER PUBLICATIONS

International Search Report for PCT International Application No. PCT/IB2019/060613, mailed on Feb. 21, 2020, 4 pages.
International Search Report for PCT International Application No. PCT/IB2019/060615, mailed on Feb. 26, 2020, 5 pages.
International Search Report for PCT International Application No. PCT/IB2019/060624, mailed on Mar. 11, 2020, 4 pages.
International Search Report for PCT International Application No. PCT/IB2019/060627, mailed on Jul. 2, 2020, 8 pages.
International Search Report for PCT International Application No. PCT/IB2019/060779, mailed on Mar. 10, 2020, 5 pages.

(Continued)

*Primary Examiner* — James E McDonough
(74) *Attorney, Agent, or Firm* — Aleksander Medved

(57) ABSTRACT

The present disclosure provides systems, devices, and methods for abrasive articles and manufacturing the same. A method includes receiving, at a shaped abrasive particle placement tool comprising cavities (1020), shaped abrasive particles (502, 504), determining whether a threshold number of cavities of the cavities (1020) includes a shaped abrasive particle situated properly therein, in response to determining there is not a threshold number of cavities of the cavities (1020) with a shaped abrasive particle (502, 504) situated properly therein, receiving, at the shaped abrasive particle placement tool, further shaped abrasive particles, and in response to determining that at least the threshold number of cavities of the cavities (1020) includes a shaped abrasive particle (502, 504) of the shaped abrasive particles situated properly therein, releasing the shaped abrasive particles (502, 504) from the shaped abrasive particle placement tool into a binding material (508) on a substrate (506) to adhere the shaped abrasive particles (502, 504) to the substrate (506).

5 Claims, 17 Drawing Sheets

(56) References Cited

U.S. PATENT DOCUMENTS

| | | | |
|---|---|---|---|
| 5,078,753 | A | 1/1992 | Broberg |
| 5,085,671 | A | 2/1992 | Martin |
| 5,152,917 | A | 10/1992 | Pieper |
| 5,201,916 | A | 4/1993 | Berg |
| 5,203,884 | A | 4/1993 | Buchanan |
| 5,213,591 | A | 5/1993 | Celikkaya |
| 5,269,821 | A | 12/1993 | Helmin |
| 5,352,254 | A | 10/1994 | Celikkaya |
| 5,366,523 | A | 11/1994 | Rowenhorst |
| 5,378,251 | A | 1/1995 | Culler |
| 5,417,726 | A | 5/1995 | Stout |
| 5,435,816 | A | 7/1995 | Spurgeon |
| 5,436,063 | A | 7/1995 | Follett |
| 5,453,106 | A | 9/1995 | Roberts |
| 5,496,386 | A | 3/1996 | Broberg |
| 5,498,268 | A | 3/1996 | Gagliardi |
| 5,520,711 | A | 5/1996 | Helmin |
| 5,609,706 | A | 3/1997 | Benedict |
| RE35,570 | E | 7/1997 | Rowenhorst |
| 5,672,097 | A | 9/1997 | Hoopman |
| 5,766,277 | A | 6/1998 | DeVoe |
| 5,946,991 | A | 9/1999 | Hoopman |
| 5,954,844 | A | 9/1999 | Law |
| 5,961,674 | A | 10/1999 | Gagliardi |
| 5,975,987 | A | 11/1999 | Hoopman |
| 5,975,988 | A | 11/1999 | Christianson |
| 5,984,988 | A | 11/1999 | Berg |
| 6,077,601 | A | 6/2000 | DeVoe |
| 6,129,540 | A | 10/2000 | Hoopman |
| 6,228,133 | B1 | 5/2001 | Thurber |
| 7,553,346 | B2 | 6/2009 | Welygan |
| 8,034,137 | B2 | 10/2011 | Erickson |
| 8,080,072 | B2 | 12/2011 | Woo |
| 8,142,531 | B2 | 3/2012 | Adefris |
| 8,142,532 | B2 | 3/2012 | Erickson |
| 8,142,891 | B2 | 3/2012 | Culler |
| 9,017,150 | B2 | 4/2015 | Keipert |
| 9,440,332 | B2 | 9/2016 | Gaeta |
| 9,457,453 | B2 | 10/2016 | Seth |
| 9,604,346 | B2 | 3/2017 | Breder |
| 9,776,302 | B2 | 10/2017 | Keipert |
| 9,969,057 | B2 | 5/2018 | Eugster |
| 2001/0003884 | A1 | 6/2001 | Wei |
| 2009/0165394 | A1 | 7/2009 | Culler |
| 2009/0169816 | A1 | 7/2009 | Erickson |
| 2012/0227333 | A1 | 9/2012 | Adefris |
| 2013/0040537 | A1 | 2/2013 | Schwabel |
| 2013/0125477 | A1 | 5/2013 | Adefris |
| 2013/0344786 | A1 | 12/2013 | Keipert |
| 2014/0106126 | A1 | 4/2014 | Gaeta |
| 2014/0290147 | A1 | 10/2014 | Seth |
| 2015/0224629 | A1 | 8/2015 | Moren |
| 2015/0291866 | A1 | 10/2015 | Arcona |
| 2016/0311081 | A1* | 10/2016 | Culler ..... B24D 11/001 |
| 2016/0311084 | A1 | 10/2016 | Culler |
| 2016/0315081 | A1 | 10/2016 | Park |
| 2017/0050293 | A1 | 2/2017 | Gaeta |
| 2017/0225299 | A1 | 8/2017 | Keipert |
| 2017/0368667 | A1 | 12/2017 | Keipert |
| 2018/0029194 | A1 | 2/2018 | Keipert |
| 2018/0086957 | A1 | 3/2018 | Sahlin |

FOREIGN PATENT DOCUMENTS

| | | |
|---|---|---|
| EP | 3319758 | 1/2017 |
| WO | WO 2003-008151 | 1/2003 |
| WO | WO 2007-005452 | 1/2007 |
| WO | WO 2011-068714 | 6/2011 |
| WO | WO 2012-112305 | 8/2012 |
| WO | WO 2012-112322 | 8/2012 |
| WO | WO 2014-131937 | 9/2014 |
| WO | WO 2014-176108 | 10/2014 |
| WO | WO 2014-206967 | 12/2014 |
| WO | WO 2015-100018 | 7/2015 |
| WO | WO 2015-100020 | 7/2015 |
| WO | WO 2015-100220 | 7/2015 |
| WO | WO 2016-028683 | 2/2016 |
| WO | WO 2016-044158 | 3/2016 |
| WO | WO 2016-064726 | 4/2016 |
| WO | WO 2016-089675 | 6/2016 |
| WO | WO 2016-205133 | 12/2016 |
| WO | WO 2016-205267 | 12/2016 |
| WO | WO 2017-007703 | 1/2017 |
| WO | WO 2017-007714 | 1/2017 |
| WO | WO 2017-083249 | 5/2017 |
| WO | WO 2017-083255 | 5/2017 |
| WO | WO 2018-080765 | 5/2018 |
| WO | WO 2018-118596 | 6/2018 |
| WO | WO 2018-118690 | 6/2018 |
| WO | WO 2018-118695 | 6/2018 |
| WO | WO 2018-134732 | 7/2018 |
| WO | WO 2018-207145 | 11/2018 |
| WO | WO 2019-215571 | 11/2019 |
| WO | WO 2020-128716 | 6/2020 |
| WO | WO 2020-128717 | 6/2020 |
| WO | WO 2020-128719 | 6/2020 |
| WO | WO 2020-128752 | 6/2020 |
| WO | WO 2020-128833 | 6/2020 |
| WO | WO 2020-128838 | 6/2020 |
| WO | WO 2020-128842 | 6/2020 |
| WO | WO 2020-128844 | 6/2020 |
| WO | WO 2020-128845 | 6/2020 |
| WO | WO 2020-128852 | 6/2020 |
| WO | WO 2020-128853 | 6/2020 |
| WO | WO 2020-128854 | 6/2020 |
| WO | WO 2020-128857 | 6/2020 |
| WO | WO 2020-128858 | 6/2020 |

OTHER PUBLICATIONS

International Search Report for PCT International Application No. PCT/IB2019/060924, mailed on Apr. 29, 2020, 4 pages.

International Search Report for PCT International Application No. PCT/IB2019/060929, mailed on Mar. 23, 2020, 4 pages.

International Search Report for PCT International Application No. PCT/IB2019/060934, mailed on Mar. 18, 2020, 5 pages.

International Search Report for PCT International Application No. PCT/IB2019/060936, mailed on Mar. 30, 2020, 5 pages.

International Search Report for PCT International Application No. PCT/IB2019/060938, mailed on Apr. 28, 2020, 4 pages.

International Search Report for PCT International Application No. PCT/IB2019/060947, mailed on Mar. 30, 2020, 5 pages.

International Search Report for PCT International Application No. PCT/IB2019/060949, mailed on Jun. 5, 2020, 4 pages.

International Search Report for PCT International Application No. PCT/IB2019/060950, mailed on Mar. 30, 2020, 5 pages.

International Search Report for PCT International Application No. PCT/IB2019/060953, mailed on Apr. 2, 2020, 4 pages.

International Search Report for PCT International Application No. PCT/IB2019/060954, mailed on Apr. 24, 2020, 5 pages.

* cited by examiner

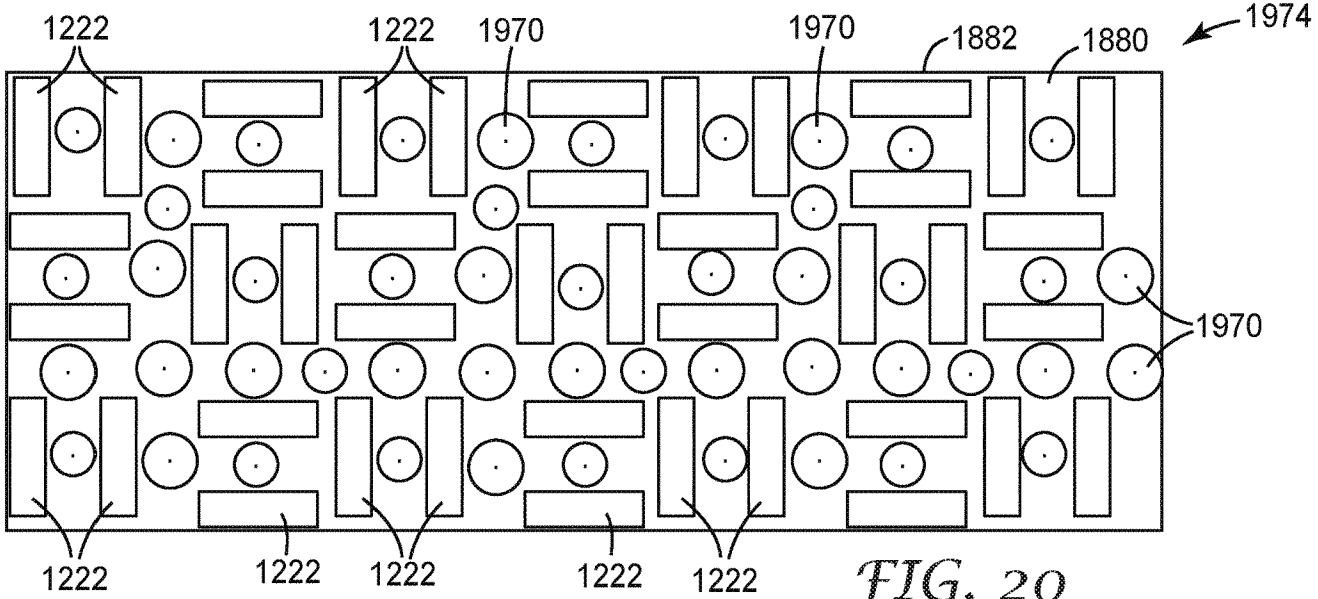
FIG. 20
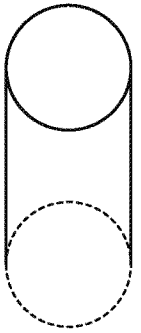
FIG. 21
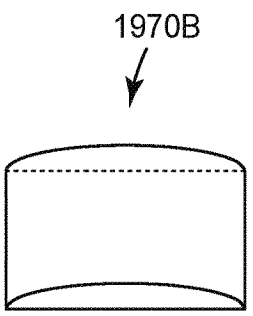
FIG. 22
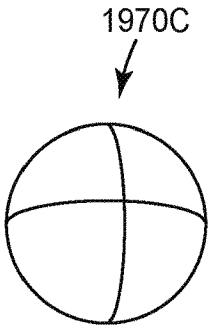
FIG. 23
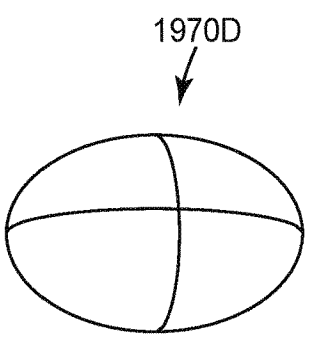
FIG. 24
FIG. 25
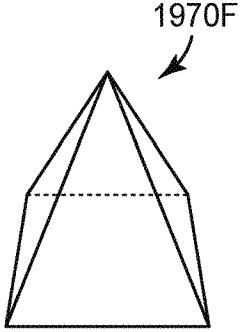
FIG. 26

PARTICLE RECEPTION IN ABRASIVE ARTICLE CREATION

CROSS REFERENCE TO RELATED APPLICATIONS

This application is a national stage filing under 35 U.S.C. 371 of PCT/IB2019/060627, filed Dec. 10, 2019, which claims the benefit of U.S. Provisional Application No. 62/781,057, filed Dec. 18, 2018, the disclosures of which are incorporated by reference in their entireties herein.

BACKGROUND

Abrasive articles made from abrasive platelets are useful for abrading, finishing, or grinding a wide variety of materials and surfaces in the manufacturing of goods. In particular, finishing of welding beads (e.g., especially mild steel welds), flash, gates, and risers off castings by offhand abrading with a handheld right-angle grinder is an important application for coated abrasive discs. In view of the above, there continues to be a need for improving the cost, performance, and/or life of the abrasive articles as well as manufacturing thereof.

SUMMARY OF THE DISCLOSURE

The present disclosure provides a method including receiving, at a shaped abrasive particle placement tool comprising cavities, shaped abrasive particles, determining whether a threshold number of cavities of the cavities includes a shaped abrasive particle of the shaped abrasive particles situated properly therein, in response to determining there is not a threshold number of cavities of the cavities with a shaped abrasive particle of the shaped abrasive particles situated properly therein, receiving, at the shaped abrasive particle placement tool, further shaped abrasive particles, and in response to determining that at least the threshold number of cavities of the cavities includes a shaped abrasive particle of the shaped abrasive particles situated properly therein, releasing the shaped abrasive particles from the shaped abrasive particle placement tool into at least one binding material on a substrate to adhere the first shaped abrasive particles and the second shaped abrasive particles to the substrate.

The method can further include one or more of: after receiving the shaped abrasive particles removing, from shaped abrasive particle placement tool, at least one of the received shaped abrasive particles improperly situated in a cavity of the cavities; before depositing the shaped abrasive particles into the at least one binding material, removing further shaped abrasive particles that are not in a respective cavity of the cavities off the shaped abrasive particle placement tool; vibrating the shaped abrasive particle placement tool to situate shaped abrasive particles of the shaped abrasive particles into a cavity of the cavities; wherein releasing the shaped abrasive particles from the shaped abrasive particle placement tool includes vibrating the shaped abrasive particle placement tool.

The present disclosure further provides another method including receiving, at a shaped abrasive particle placement tool comprising first cavities with a first specified characteristic and second cavities with a lesser corresponding characteristic, first shaped abrasive particles with a corresponding characteristic greater than the second characteristic and less than the first characteristic, after receiving the first abrasive particles, receiving, at the shaped abrasive particle placement tool, second shaped abrasive particles with a corresponding characteristic less than the second characteristic, and releasing the shaped abrasive particles from the shaped abrasive particle placement tool into at least one binding material on a substrate to adhere the first shaped abrasive particles and the second shaped abrasive particles to the substrate.

The method can further include one or more of: before receiving the second shaped abrasive particles and after receiving the first shaped abrasive particles, removing first shaped abrasive particles that are not in a respective first cavity of the first cavities of the shaped abrasive particle placement tool or removing first shaped abrasive particles that are not properly situated in a respective first cavity of the first cavities of the shaped abrasive particle placement tool and receiving further first shaped abrasive particles until a threshold number of the first cavities includes a first shaped abrasive particle situated therein; before depositing the shaped abrasive particle placement tool into the at least one binding material, sweeping or blowing second shaped abrasive particles off that are not in a respective second cavity of the second cavities off the shaped abrasive particle placement tool and receiving further second shaped abrasive particles until a threshold number of the second cavities includes a second shaped abrasive particle situated therein; wherein the characteristic includes a height, width, or depth; wherein the first shaped abrasive particles or the second shaped abrasive particles are not equilateral triangles; further comprising vibrating the shaped abrasive particle placement tool to situate a first shaped abrasive particle of the first shaped abrasive particles into a first cavity of the first cavities; and wherein releasing the shaped abrasive particles from the shaped abrasive particle placement tool includes vibrating the shaped abrasive particle placement tool.

The present disclosure further provides a shaped abrasive particle placement tool including a substrate including an abrasive article receiving surface and a back surface opposite the abrasive article receiving surface, cavities formed in the substrate including one or more sidewalls, the cavities including first cavities and second cavities, the first cavities including a first width and first length at the abrasive article receiving surface, and a first depth indicating a distance the first cavities extend from the abrasive article receiving surface towards the back surface, the second cavities including a second width and second length at the abrasive article receiving surface, and a second depth indicating a distance the second cavities extend from the abrasive article receiving surface towards the back surface, wherein one or more of (1) the first width is greater than the second width, (2) the first length is greater than the second length, or (3) the first depth is greater than the second depth, first shaped abrasive particles situated in the first cavities, the first shaped abrasive particles including (1) a width and length less than the first width and first length, respectively, and greater than the second width or second length, respectively, or (2) a height greater than a threshold greater than the second depth and less than the threshold greater than the first depth, and second shaped abrasive particles situated in the second cavities, the second shaped abrasive particles including (1) a width and length less than the second width and the second length, respectively, or (2) a height less than the threshold greater than the second depth.

The shaped abrasive particle placement tool can further include one or more of: wherein the first cavities are situated in a non-random orientation relative to one another; wherein the first width is greater than the second width or the first length is greater than the second length; wherein the first shaped abrasive particles include a width and length less than the first width and first length, respectively, and greater than the second width or second length, respectively; wherein the second shaped abrasive particles include a width and length less than the second width and the second length, respectively; wherein the first depth is greater than the second depth; wherein the first abrasive articles include a height greater than a threshold greater than the second depth and less than the threshold greater than the first depth; and the second abrasive articles include a height less than the threshold greater than the second depth; wherein at least one of the first and second shaped abrasive particles includes a non-equilateral triangle shape; wherein the first cavities include at least two at least partial triangular walls connected to each other and separated by two sidewalls; wherein the first cavities include four at least partially triangular walls forming a pyramid or truncated pyramid shape; wherein the first shaped abrasive particles and the second shaped abrasive particles include a respective different characteristic; wherein the characteristic is surface area of a major surface of the first shaped abrasive particles and the second shaped abrasive particles; wherein the first cavities and the second cavities include different respective depths and the first cavities and the second cavities are situated in an alternating pattern in the substrate; wherein at least one second cavity of the second cavities is situated between two nearest first cavities with respective major surfaces within 10 degrees of a parallel with each other; wherein the cavities include pods of cavities situated with major surfaces within 10 degrees of perpendicular to each nearest pod, each pod comprising a second cavity of the second cavities situated between two first cavities of the first cavities, and wherein the respective major surfaces of the first cavities and second cavity of the pod are within 10 degrees of parallel to each other; wherein the cavities further include third cavities, a width of the third cavities is less than the second width which is less than the first width; and wherein the cavities are situated with a second cavity of the second cavities between a first cavity of the first cavity and a third cavity of the third cavities; wherein the characteristic includes aspect ratio indicating a ratio of height a shaped abrasive particle extends from an axis perpendicular to the major surface of the substrate to a width of the element parallel to the major surface of the substrate; and wherein the first cavities and the second cavities are situated randomly relative to one another in the substrate.

BRIEF DESCRIPTION OF THE FIGURES

The drawings illustrate generally, by way of example, but not by way of limitation, various embodiments discussed in the present document.

FIG. 20 illustrates, by way of example a diagram of an embodiment of the holding device.

FIGS. 21, 22, 23, 24, 25, and 26 illustrate, by way of example, diagrams of respective embodiments of protrusions of different shapes.

DETAILED DESCRIPTION

Figure 1:
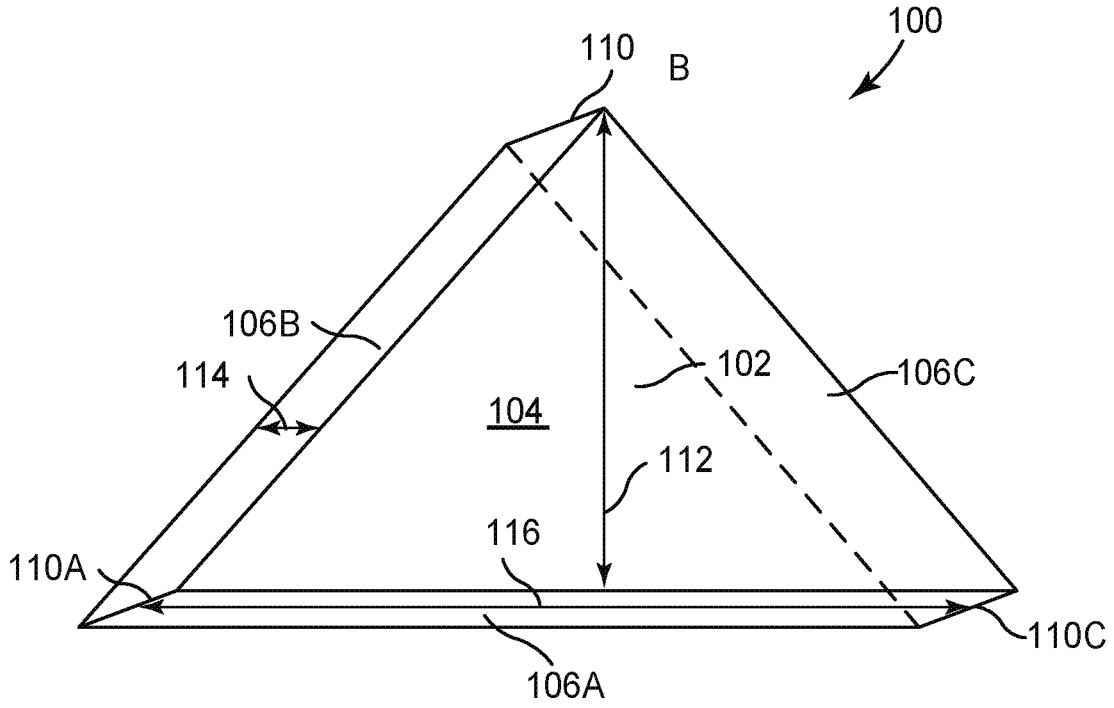
FIG. 1 illustrates, by way of example, a diagram of an embodiment of a shaped abrasive particle.

Reference will now be made in detail to certain embodiments of the disclosed subject matter, examples of which are illustrated in part in the accompanying drawings. While the disclosed subject matter will be described in conjunction with the enumerated claims, it will be understood that the exemplified subject matter is not intended to limit the claims to the disclosed subject matter.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for description only and not of limitation. Any use of section headings is intended to aid reading of the document and is not to be interpreted as limiting; information that is relevant to a section heading may occur within or outside of that section.

In the methods described herein, the acts can be carried out in any order without departing from the principles of the disclosure, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%.

As used herein "shaped abrasive particle" means an abrasive particle having a predetermined or non-random shape. One process to make a shaped abrasive particle, such as a shaped ceramic abrasive particle, includes shaping the precursor ceramic abrasive particle in a mold having a predetermined shape to make ceramic shaped abrasive particles. Ceramic shaped abrasive particles, formed in a mold, are one species in the genus of shaped ceramic abrasive particles. Other processes to make other species of shaped ceramic abrasive particles include extruding the precursor ceramic abrasive particle through an orifice having a predetermined shape, printing the precursor ceramic abrasive particle though an opening in a printing screen having a predetermined shape, or embossing the precursor ceramic abrasive particle into a predetermined shape or pattern. In other examples, the shaped ceramic abrasive particles can be cut from a sheet into individual particles. Examples of suitable cutting methods include mechanical cutting, laser cutting, or water jet cutting. Non-limiting examples of shaped ceramic abrasive particles include shaped abrasive particles, such as triangular plates, or elongated ceramic rods/filaments. Shaped ceramic abrasive particles are generally homogenous or substantially uniform and maintain their sintered shape without the use of a binder such as an organic or inorganic binder that bonds smaller abrasive particles into an agglomerated structure and excludes abrasive particles obtained by a crushing or comminution process that produces abrasive particles of random size and shape. In many embodiments, the shaped ceramic abrasive particles comprise a homogeneous structure of sintered alpha alumina or consist essentially of sintered alpha alumina.

FIG. 1 illustrates, by way of example, a diagram of an embodiment of a shaped abrasive particle 100. The shaped abrasive particle 100 is illustrated as an equilateral triangle conforming to a truncated pyramid. Shaped abrasive particles of other shapes are within the scope of this disclosure. As shown in FIG. 1 the shaped abrasive particle 100 includes a truncated regular triangular pyramid bounded by a triangular top major surface 104, and plurality of sloping sides 106A, 106B, 106C and a triangular bottom major surface 102 opposite the triangular top major surface 104. In the case of shaped abrasive particle 100, all the slope angles have about equal value. In some embodiments, side edges 110A, 110B, and 110C have an average radius of curvature in a range of from about 0.5 μm to about 80 μm, about 10 μm to about 60 μm, or less than, equal to, or greater than about 0.5 μm, 5, 10, 15, 20, 25, 30, 35, 40, 45, 50, 55, 60, 65, 70, 75, or about 80 μm.

In the embodiment shown in FIG. 1, sides 106A, 106B, and 106C have about equal characteristics and form dihedral angles with the bottom major surface 102 of about 82 degrees (corresponding to a slope angle of 82 degrees). However, it will be recognized that other dihedral angles (including 90 degrees) can be used. For example, the dihedral angle between each of the sides may independently range from 45 to 90 degrees (for example, from 70 to 90 degrees, or from 75 to 85 degrees). Edges connecting sides 106, bottom major surface 102, and top major surface 104 can have any suitable length. For example, a length of the edges may be in a range of from about 0.5 μm to about 2000 μm, about 150 μm to about 200 μm, or less than, equal to, or greater than about 0.5 μm, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1600, 1650, 1700, 1750, 1800, 1850, 1900, 1950, or about 2000 μm.

The shaped abrasive particle 100 includes a height 112, a width 114, and a length 116. Different shaped abrasive particles can have different height, length, and/or width. The height 112 is the distance from the side 106A that will contact the surface of an abrasive article substrate to an opposite edge 110B. The width 114 is the distance from the triangular top major surface 104 to the triangular bottom major surface 102. The length 116 is the distance between edges 110A, 110C of the side 106A that will contact the surface of an abrasive article substrate. Some embodiments herein regard shaped abrasive articles that include shaped abrasive particles of different length, width, shape, or other characteristic.

Figure 2:
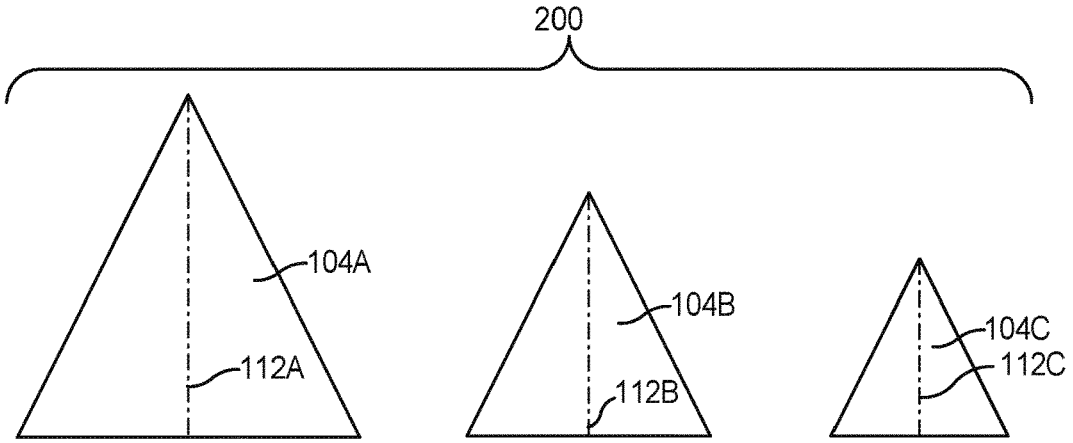
FIG. 2 illustrates, by way of example, a diagram of an embodiment of shaped abrasive particles with varying heights.

FIG. 2 illustrates, by way of example, a diagram of an embodiment of shaped abrasive particles 200 with varying heights. A height 112A of a top major surface 104A of a first shaped abrasive particle is greater than a height 112B of a top major surface 104B of a second shaped abrasive particle which is greater than a height 112C of a top major surface 104C of a third shaped abrasive particle. While the top major surface 104 and bottom major surface 102 of FIGS. 1 and 2 are illustrated as being triangular, the top major surface 104 and bottom major surface 102 of a shaped abrasive particle can be a different shape. A different shape can include a polygon, an ellipse, an irregular shape, or a combination thereof. The shape can be planar, rounded, or a combination thereof. Using a shape that tapers can aid in loading the tooling for making a shaped abrasive article, as is described regarding FIGS. 9-33. Examples of shapes that taper include triangles, trapezoids, cones, parabolas, pyramids, and some irregular shapes, among others.

Figure 3:
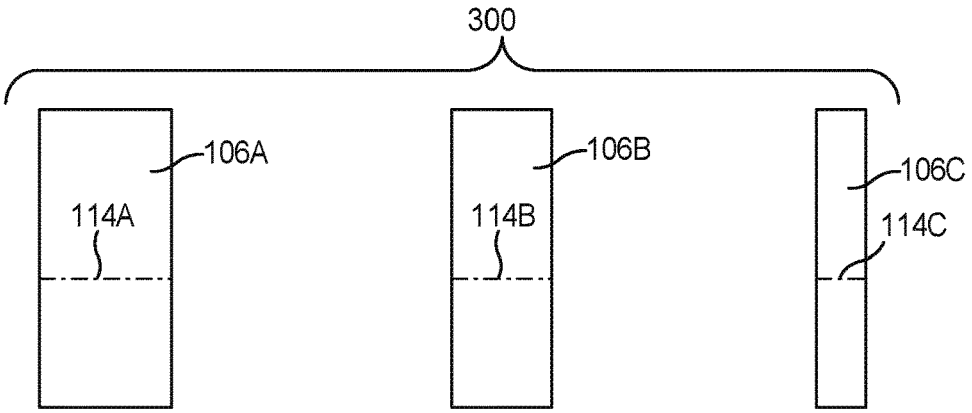
FIG. 3 illustrates, by way of example, a diagram of an embodiment of shaped abrasive particles with varying widths.

FIG. 3 illustrates, by way of example, a diagram of an embodiment of shaped abrasive particles 300 with varying widths. A width 114A of a side 106A of a first shaped abrasive particle is greater than a width 114B of a side 106B of a second shaped abrasive particle which is greater than a width 114C of a side 106C of a third shaped abrasive particle.

Figure 4:
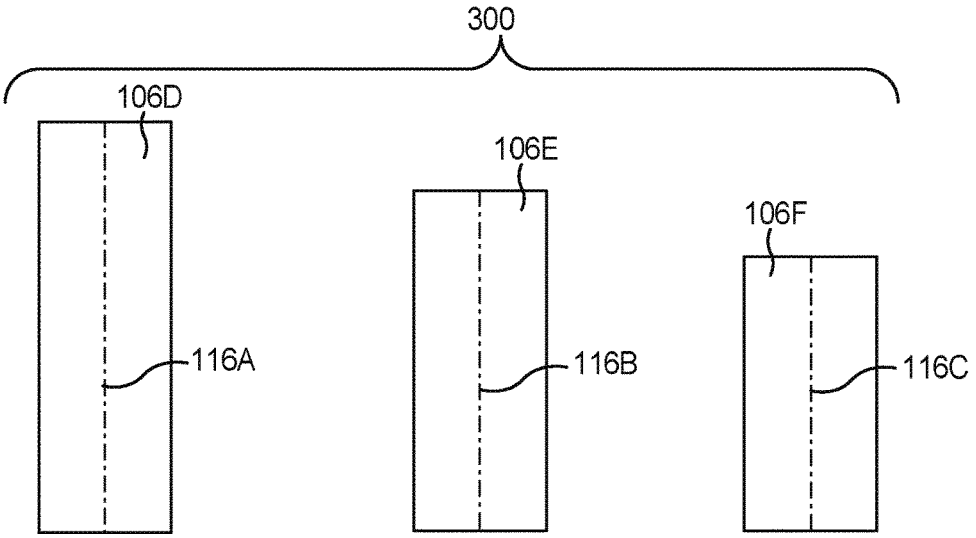
FIG. 4 illustrates, by way of example, a diagram of an embodiment of shaped abrasive particles with varying lengths.

FIG. 4 illustrates, by way of example, a diagram of an embodiment of shaped abrasive particles 400 with varying lengths. In FIG. 4, a length 116A of a side 106D of a first shaped abrasive particle is greater than a length 116B of a side 106E of a second shaped abrasive particle which is greater than a length 116C of a side 106F of a third shaped abrasive particle.

Shaped abrasive particles of different characteristics or shapes can be attached to a substrate of a shaped abrasive article. The shaped abrasive article can include an elliptical, rectangular (or other polygonal), or irregular footprint. The shaped abrasive particles can be attached using a binding agent that adheres the shaped abrasive particle to the substrate. The shaped abrasive particles can be selectively deposited on a binding agent-coated substrate in a deliberate manner, such that the shaped abrasive particles form a pattern or are otherwise placed in a deliberate location and orientation on the substrate. The pattern can include shaped abrasive particles of different sizes or shapes situated relative to one another in regular repetition. The pattern can include a wide array of intentional designs. The pattern can help provide a specified grinding characteristic when the shaped abrasive particles are situated in contact with an object and moved so the abrasive particles remove a portion of a surface of the object. The grinding characteristic can include a pressure, a pattern, a depth, a smoothness, or the like.

Some patterns can include the shaped abrasive particles aligned either substantially parallel or substantially perpendicular to each other. As used herein, parallel shaped abrasive particles means that major surfaces of the shaped abrasive particles face about the same direction (lines perpendicular to major surfaces of respective shaped abrasive particles are about parallel). As used herein perpendicular shaped abrasive particles means that major surfaces of the shaped abrasive particles face respective directions that are about 90 degrees from one another (lines perpendicular to major surfaces of respective shaped abrasive particles are about perpendicular). With reference to the shaped abrasive particle 100, the top major surface 104 and the bottom major surface 102 are examples of major surfaces.

Some other patterns include the shaped abrasive particles aligned parallel to one another, perpendicular to one another, or some angle therebetween. For example, a first shaped abrasive particle can be aligned about 5 degrees, 10 degrees, 20 degrees, 30 degrees, 45 degrees, 60 degrees, 75 degrees, 85 degrees, or some angle therebetween, from a most proximate (nearest) shaped abrasive particle.

Yet other patterns include shaped abrasive particles of different hardness situated in specified or random locations on the substrate. For example, a harder shaped abrasive particle can be situated to contact a surface of the object first and a softer shaped abrasive particle can be situated to contact the surface of the object second. In another example, a shaped abrasive particle with a hardness configured to break upon contact with the object can be situated at a specified or random location on the substrate. These shaped abrasive particles are sometimes called grinding aids. A grinding aid can have a Moh's hardness less than aluminum oxide, while a shaped abrasive particle can have a Moh's hardness greater than aluminum oxide. The shaped abrasive particles can include diamond, cubic boron nitride (CBN), aluminum oxide, a combination thereof, or the like.

Various abrasive articles with various patterns of shaped abrasive particles and techniques of how to make and use the articles are discussed with reference to the remaining FIGS.

Figure 5A:
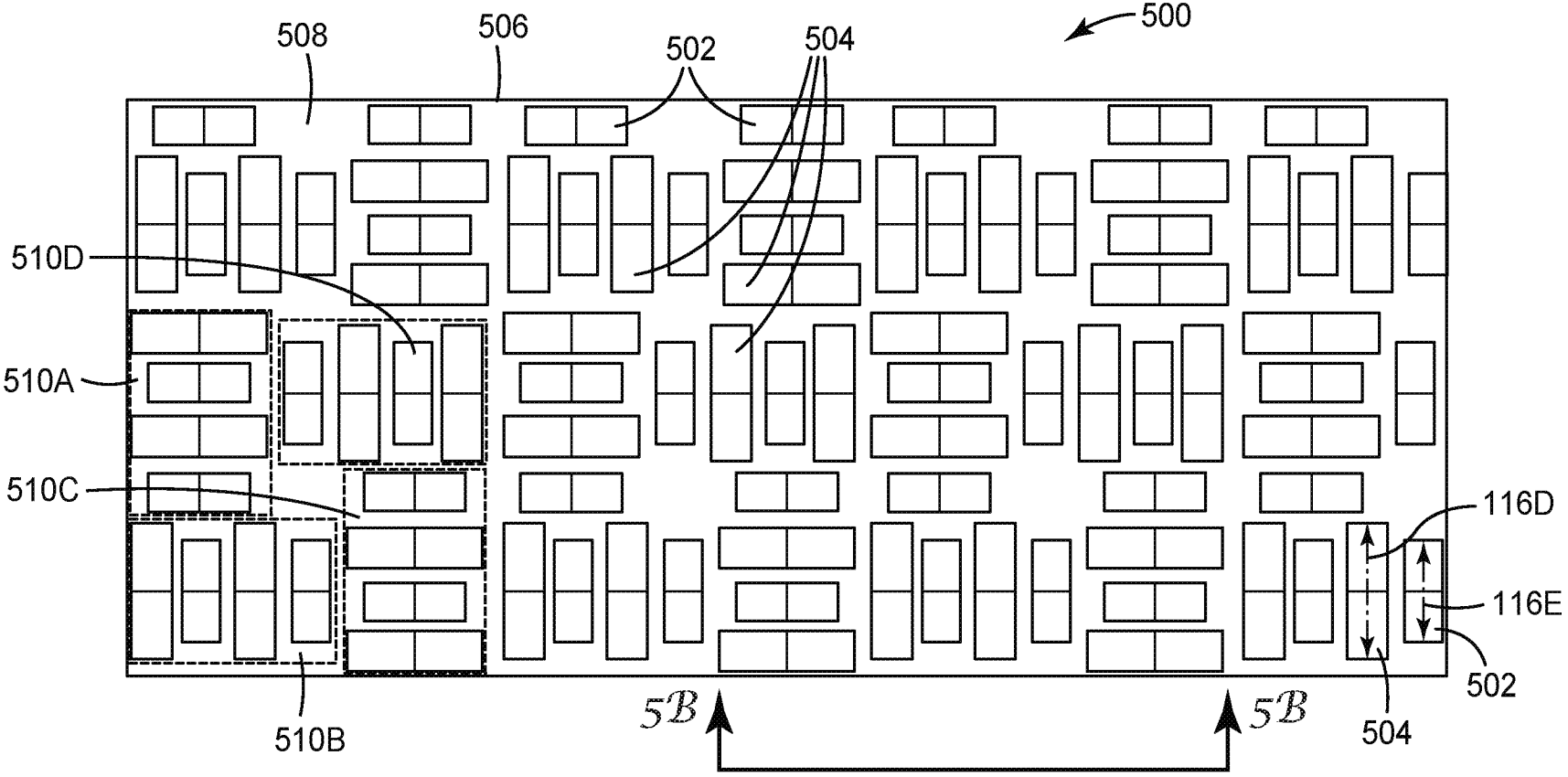
FIGS. 5A and 5B illustrate, by way of example, a diagram of an embodiment of an abrasive article.
Figure 5B:
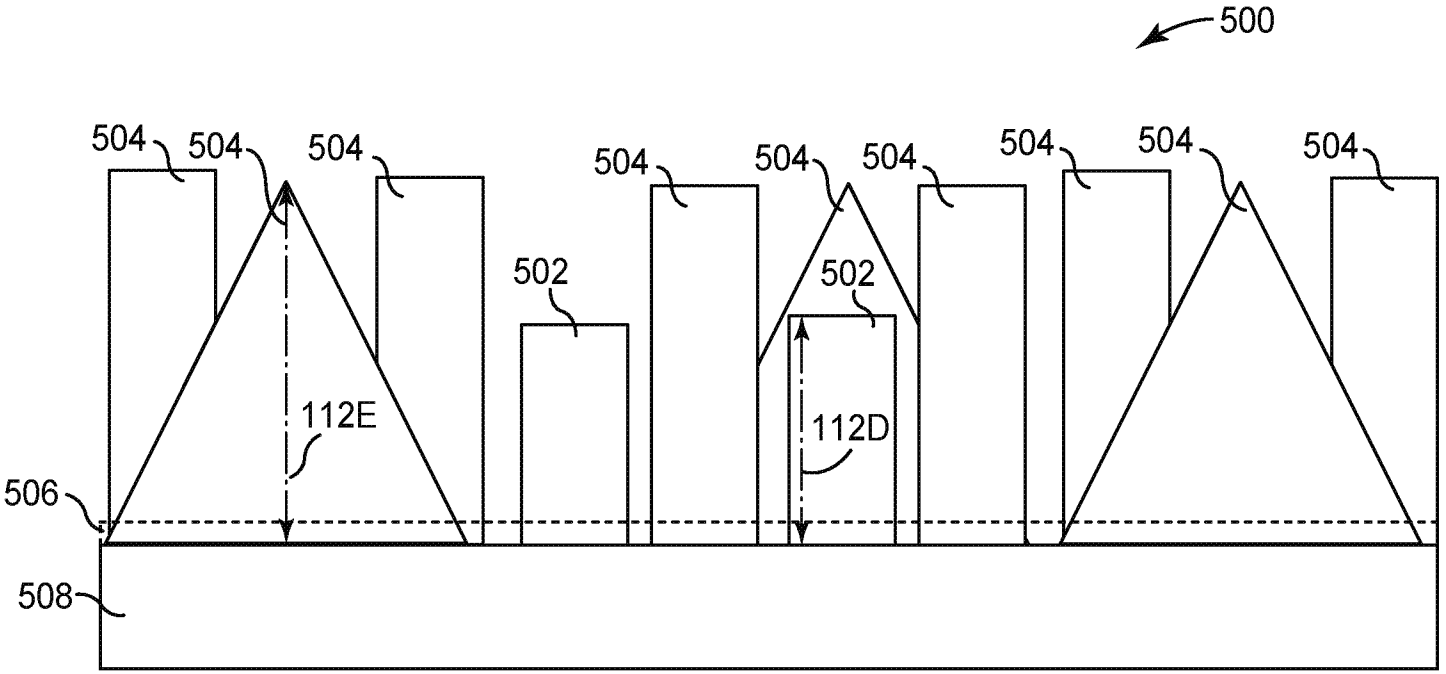

FIGS. 5A and 5B illustrate, by way of example, a diagram of an embodiment of an abrasive article 500. The shaped abrasive article 500 as illustrated includes shaped abrasive particles 502 and 504 selectively adhered to substrate 506 by a binding agent 508. The shaped abrasive particles 502 and 504 include different lengths 116D, 116E and heights 112D, 112E.

Some of the shaped abrasive particles 502 and shaped abrasive particles 504 can be selectively situated relative to one another in pods 510A, 510B, 510C, and 510D. The pods 510A-510D can be selectively situated relative to one another. In such a manner, the shaped abrasive article can include a micro pattern (a pattern where individual shaped abrasive particles are situated relative to other shaped abrasive particles) and a macro pattern (a pattern defined by pods of multiple shaped abrasive particles situated relative to other pods). The micro pattern of the article 500 includes four shaped abrasive particles including alternating shaped abrasive particles 502 and shaped abrasive particles 504 in repetition. In the pod 510, shaped abrasive particles 502 and 504 alternate with a shaped abrasive particle 502 parallel to and situated between two shaped abrasive particles 504. The macro pattern of the article 500 includes most proximate pods situated perpendicular to each other. Parallel and perpendicular regarding pods include the direction the top major surface 104 and bottom major surface 102 of the shaped abrasive particles 502, 504 of the pod 510 are facing relative to the direction the top major surface 104 and bottom major surface 102 of the shaped abrasive particles 502, 504 of another pod.

The abrasive particles 502, 504 can include ceramic, diamond, a combination thereof, or other material. The abrasive particles 502, 504 can be fired or otherwise processed to have a specified hardness. The specified hardness can be within a specified tolerance. A shaped abrasive particle that is harder can remove material from an object that is softer. If a shaped abrasive particle is softer than the object, it can break and change the pressure or other grinding characteristic of the article 500. In some embodiments, some of the abrasive particles 502, 504 can include grinding aid that transfers to the article being ground. The grinding aid can be melted by heat of the grinding.

The abrasive particles 502, 504 as illustrated include different heights 112D and 112E, respectively. The differing heights can allow the taller shaped abrasive particles 504 to contact the object before the shaped abrasive particles 502. The shaped abrasive particles 504 can grind the object until they become about the same height or shorter than the shaped abrasive particles 502. The shaped abrasive particles 502 can include a different grinding characteristic than the shaped abrasive particles 504. For example, the shaped abrasive particles 502 can be softer, include a differently shaped grinding point, or the like.

The binding agent 508 can include an epoxy, resin, or a combination thereof. The binding agent 508 can include a resinous adhesive. In some examples, the binding agent 508 can include abrasive particles distributed therein. The resinous adhesive can include one or more resins chosen from a phenolic resin, an epoxy resin, a urea-formaldehyde resin, an acrylate resin, an aminoplast resin, a melamine resin, an acrylated epoxy resin, a urethane resin, a polyester resin, a dying oil, and mixtures thereof.

The substrate 506 can be flexible or rigid. Examples of suitable materials for forming a flexible backing include a polymeric film, a metal foil, a woven fabric, a knitted fabric, paper, vulcanized fiber, a staple fiber, a continuous fiber, a nonwoven, a foam, a screen, a laminate, and combinations thereof. The substrate 506 can be shaped to allow the abrasive article to be in the form of sheets, discs, belts, pads, or rolls. In some embodiments, the substrate 506 can be sufficiently flexible to allow coated abrasive article to be formed into a loop to make an abrasive belt that can be run on suitable grinding equipment. In other embodiments, the substrate 506 can be cut to be circular, rectangular, or other shape.

Figure 6:
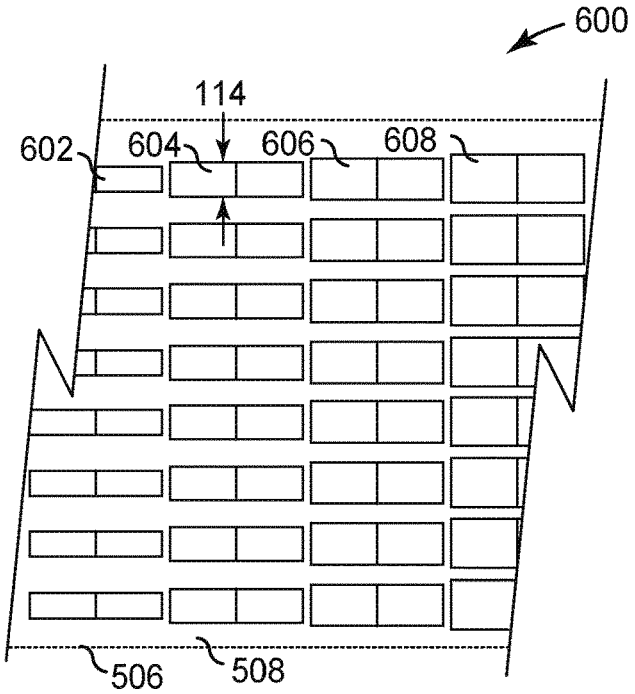
FIG. 6 illustrates, by way of example, a diagram of an embodiment of another abrasive article.

FIG. 6 illustrates, by way of example, a diagram of an embodiment of another abrasive article 600. The abrasive article 600 as illustrated includes shaped abrasive particles 602, 604, 606, and 608 selectively adhered to the substrate 506 by the binding agent 508. The shaped abrasive particles 602, 604, 606, and 608 include different widths 114. The shaped abrasive particles 602, 604, 606, and 608 can have same or different lengths and same or different heights. The pattern of the abrasive article 600 includes the shaped abrasive particles 602, 604, 606, and 608 in increasing width 114 order. Using the shaped abrasive particles 602, 604, 606, and 608 in increasing width 114 order can help gradually increase a width cut out of an object to be ground. It takes less force on any specific shaped abrasive particle when multiple particles are digging a trench vs one particle doing the whole job. Thus, it takes less force to cut a narrower trench with one or more shaped abrasive particles and then increase the width of the trench using more shaped abrasive particles than to cut the original width trench without the pilot, narrower trench. In some embodiments, a harder, possibly more expensive shaped abrasive particle can be situated to contact the object and create a pilot cut. A softer, possibly less expensive shaped abrasive partible can be situated to contact the object after the harder shaped abrasive particle, or vice versa.

Figure 7:
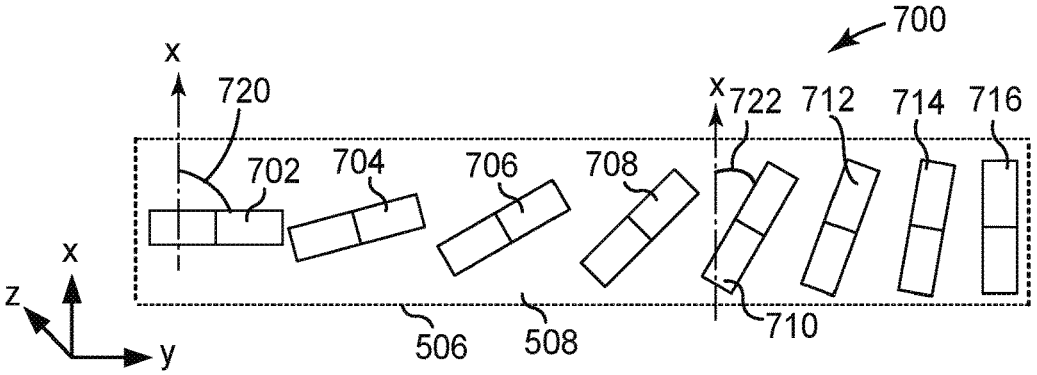
FIG. 7 illustrates, by way of example, a diagram of an embodiment of another abrasive article.

FIG. 7 illustrates, by way of example, a diagram of an embodiment of another abrasive article 700. The abrasive article 700 as illustrated includes shaped abrasive particles 702, 704, 706, 708, 710, 712, 714, and 716 selectively adhered to the substrate 506 by the binding agent 508. The shaped abrasive particles 702, 704, 706, 708, 710, 712, 714, and 716 are oriented at different angles relative to an axis (e.g., x-axis or y-axis). In the article 700, the shaped abrasive particle 702 is situated perpendicular to the x-axis and the shaped abrasive particle 716 is situated parallel to the x-axis. The shaped abrasive particles 704, 706, 708, 710, 712, and 714 situated somewhere between zero and ninety degrees to the x-axis. Perpendicular and parallel or another angle of a shaped abrasive particle, as previously discussed, is relative to a major surface of the particle. Examples of the angle are provided in FIG. 7 with angles 720 and 722.

Figure 8:
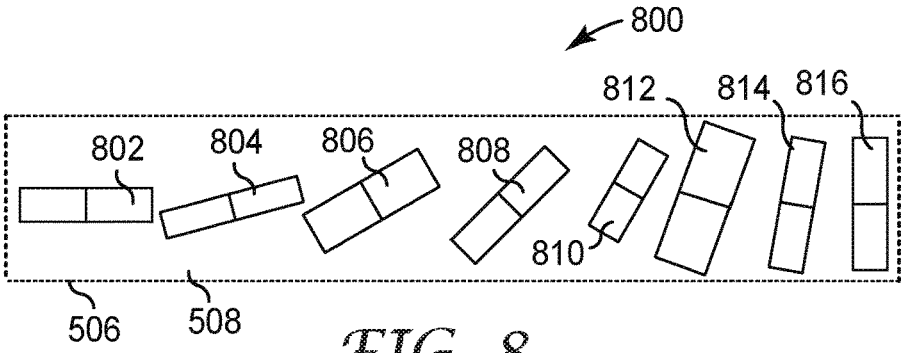
FIG. 8 illustrates, by way of example, a diagram of an embodiment of another abrasive article.

FIG. 8 illustrates, by way of example, a diagram of an embodiment of another abrasive article 800. The abrasive article 800 as illustrated includes shaped abrasive particles 802, 804, 806, 808, 810, 812, 814, and 816 selectively adhered to the substrate 506 by the binding agent 508. Similar to the shaped abrasive particles 702, 704, 706, 708, 710, 712, 714, and 716, the shaped abrasive particles 802, 804, 806, 808, 810, 812, 814, and 816 are oriented at different angles relative to an axis (e.g., x-axis or y-axis). Unlike the shaped abrasive particles 702, 704, 706, 708, 710, 712, 714, and 716, the shaped abrasive particles 802, 804, 806, 808, 810, 812, 814, and 816 include a variety of different widths and lengths, and possibly heights.

Making the abrasive articles 500, 600, 700, and 800 can include unique challenges not realized in forming an abrasive article with shaped abrasive particles of substantially uniform shape and size. For example, a shaped abrasive particle of smaller width can fit into a cavity for a shaped abrasive particle of larger width, but not vice versa. Thus, if the shaped abrasive particles with smaller width are provided before the shaped abrasive particles with larger width, the shaped abrasive particles with larger width may have fewer cavities available. This situation can be avoided by carefully choosing which shaped abrasive particles are provided and in which order the shaped abrasive particles are provided.

Figure 9:
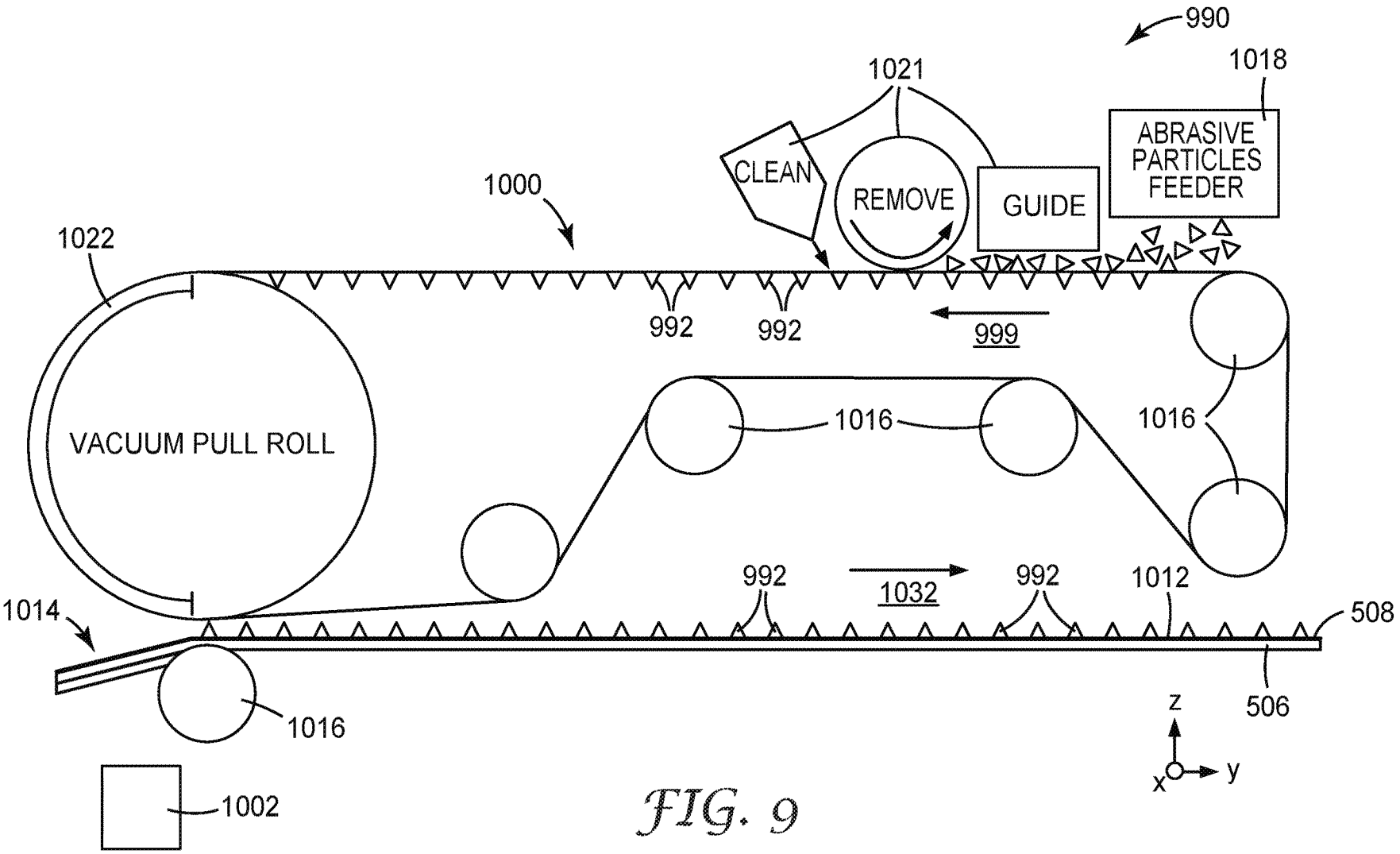
FIG. 9 illustrates, by way of example, a diagram of an embodiment of a shaped abrasive article maker.

FIG. 9 illustrates, by way of example, a diagram of an embodiment of a shaped abrasive article maker 990. The abrasive article maker 990 includes shaped abrasive particles 992 removably disposed within cavities 1020 (see FIG. 10) of production tool 1000 having first web path 999 guiding production tool 1000 through coated abrasive article maker 990 such that it wraps a portion of an outer circumference of shaped abrasive particle transfer roll 1022. Apparatus 990 can include, for example, idler roller 1016 and make coat delivery system 1002. These components unwind substrate 506, deliver binding agent 508 via make coat delivery system 1002 to a make coat applicator and apply make coat resin to first major surface 1012 of substrate 506. Thereafter resin coated substrate 1014 is positioned by idler roll 1016 for application of shaped abrasive particles 992 to first major surface 1012 coated with binding agent 508. Second web path 1032 for resin coated backing 1014 through coated abrasive article maker apparatus 990 such that it wraps a portion of the outer circumference of shaped abrasive particle transfer roll 1022 with resin layer positioned facing the dispensing surface 212 of production tool 1000 that is positioned between resin coated backing 1014 and the outer circumference of the shaped abrasive particle transfer roll 1022. Suitable unwinds, make coat delivery systems, make coat resins, coaters and backings are known to those of skill in the art. Make coat deliver system 1002 can be a simple pan or reservoir containing the make coat resin or a pumping system with a storage tank and delivery plumbing to translate binding agent 508 to the needed location. The substrate 506 can include a cloth, paper, film, nonwoven, scrim, or other web substrate. Make coat delivery system 1002 can be, for example, a coater, a roll coater, a spray system, a die coater, or a rod coater. Alternatively, a pre-coated coated backing can be positioned by idler roll 1016 for application of shaped abrasive particles 992 to the first major surface.

Figure 10:
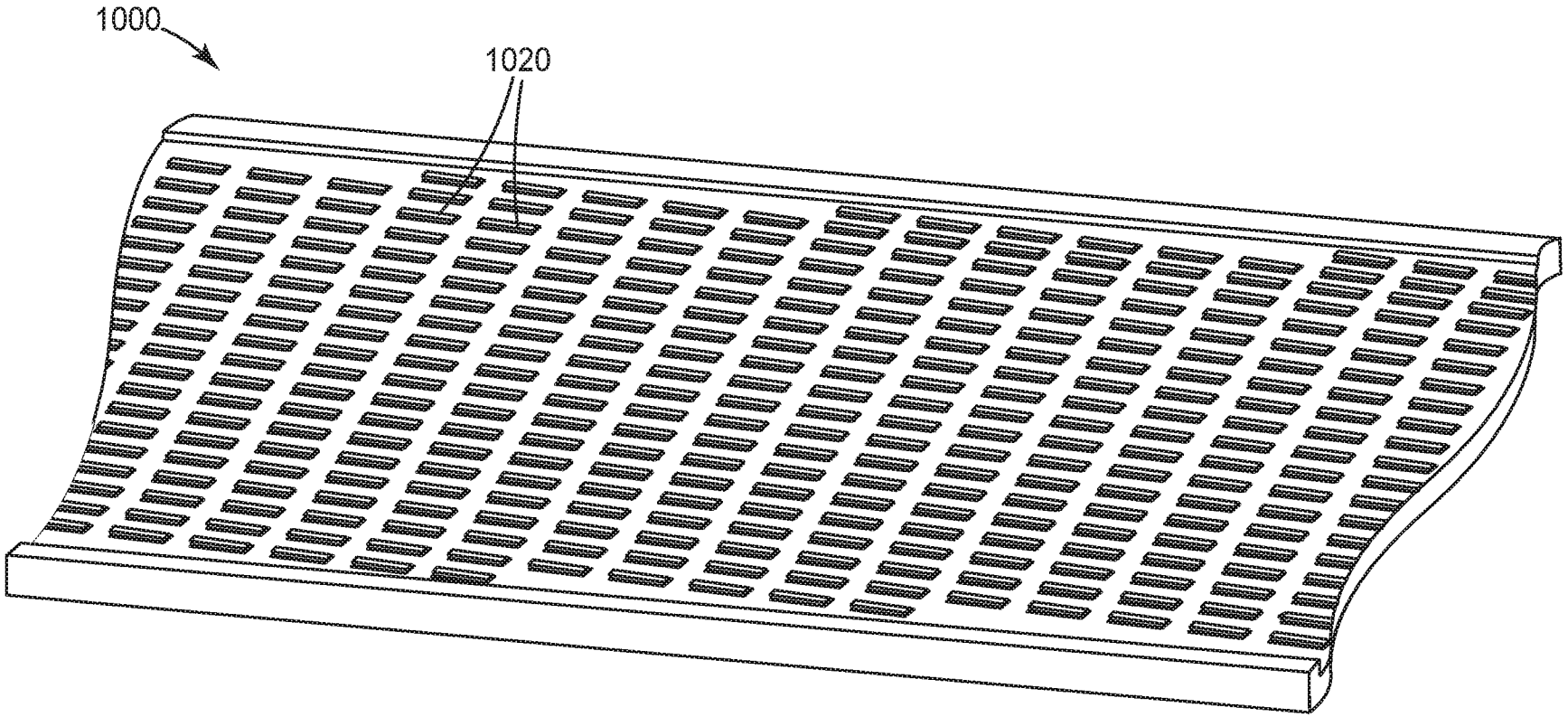
FIG. 10 illustrates, by way of example, a diagram of an embodiment of the production tool.

FIG. 10 illustrates, by way of example, a diagram of an embodiment of the production tool. As shown in FIG. 10, production tool 1000 comprises a plurality of cavities 1020 having a complimentary shape to intended shaped abrasive particle 992 to be contained therein. Shaped abrasive particle feeder 1018 supplies at least some shaped abrasive particles 992 to production tool 1000. Shaped abrasive particle feeder 1018 can supply an excess of shaped abrasive particles 992 such that there are more shaped abrasive particles 992 present per unit length of production tool in the machine direction than cavities 1020 present. Supplying an excess of shaped abrasive particles 992 helps to ensure that a desired number of cavities 1020 within the production tool 1000 are eventually filled with shaped abrasive particle 992. Since the bearing area and spacing of shaped abrasive particles 992 is often designed into production tooling 1000 for the specific grinding application it is desirable to not have too many unfilled cavities 1020. Shaped abrasive particle feeder 1018 can be the same width as the production tool 1000 and can supply shaped abrasive particles 992 across the entire width of production tool 1000. Shaped abrasive particle feeder 1018 can be, for example, a vibratory feeder, a hopper, a chute, a silo, a drop coater, or a screw feeder.

Optionally, filling assist member 1021 is provided after shaped abrasive particle feeder 1018 to move shaped abrasive particles 992 around on the surface of production tool 1000 and to help orientate or slide shaped abrasive particles 992 into the cavities 1020. Filling assist member 1021 can be, for example, a doctor blade, a felt wiper, a brush having a plurality of bristles, a vibration system, a blower or air knife, a vacuum box, or combinations thereof. Filling assist member 1021 moves, translates, sucks, or agitates shaped abrasive particles 992 on dispensing surface 1012 (top or upper surface of production tool 1000 in FIG. 9) to place more shaped abrasive particles 992 into cavities 1020. Without filling assist member 1021, generally at least some of shaped abrasive particles 992 dropped onto dispensing surface 1012 will fall directly into cavity 1020 and no further movement is required but others may need some additional movement to be directed into cavity 1020. Optionally, filling assist member 1021 can be oscillated laterally in the cross-machine direction or otherwise have a relative motion such as circular or oval to the surface of production tool 1000 using a suitable drive to assist in completely filling each cavity 1020 in production tool 1000 with a shaped abrasive particle 992. If a brush is used as the filling assist member 1021, the bristles may cover a section of dispensing surface 1012 from 2-60 inches (5.0-153 cm) in length in the machine direction across all or most all the width of dispensing surface 1012, and lightly rest on or just above dispensing surface 1012 and be of a moderate flexibility. Vacuum box, if used as filling assist member 1021, can be in conjunction with production tool 1000 having cavities 1020 extending completely through production tool 1000. Vacuum box is located near shaped abrasive particle feeder 1018 and may be located before or after shaped abrasive particle feeder 1018 or encompass any portion of a web span between a pair of idler rolls 1016 in the shaped abrasive particle filling and excess removal section of the apparatus generally illustrated at 1021. Alternatively, production tool 1000 can be supported or pushed on by a shoe or a plate to assist in keeping it planar in this section of the apparatus instead or in addition to vacuum box 1025. As shown in FIG. 9, it 3*s* possible to include one or more assist members 1021 to remove excess shaped abrasive particles 992, in some embodiments it may be possible to include only one assist member 1021.

After leaving the shaped abrasive particle filling and excess removal section of apparatus 990 generally illustrated at 1021, shaped abrasive particles 992 in production tool 1000 travel towards resin coated hacking 1014. Shaped abrasive particle transfer roll 1022 is provided and production tooling 1000 can wrap at least a portion of the roll's circumference. In some embodiments, production tool 1000 wraps between 30 to 180 degrees, or between 90 to 180 degrees of the outer circumference of shaped abrasive particle transfer roll 1022. In some embodiments, the speed of the dispensing surface 1012 and the speed of the resin layer of resin coated hacking 1014 are speed matched to each other within ±10 percent, ±5 percent, or ±1 percent, for example.

Various methods can be employed to transfer shaped abrasive particles 992 from cavities 1020 of production tool 1000 to resin coated backing 1014. One method includes a pressure assist method where each cavity 1020 in production tooling 1000 has two open ends or the back surface or the entire production tooling 1000 is suitably porous and shaped abrasive particle transfer roll 1022 has a plurality of apertures and an internal pressurized source of air. With pressure assist, production tooling 1000 does not need to be inverted but it still may be inverted. Shaped abrasive particle transfer roll 1022 can also have movable internal dividers such that the pressurized air can be supplied to a specific arc segment or circumference of the roll to blow shaped abrasive particles 992 out of the cavities and onto resin coated backing 1014 at a specific location. In some embodiments, shaped abrasive particle transfer roll 1022 may also be provided with an internal source of vacuum without a corresponding pressurized region or in combination with the pressurized region typically prior to the pressurized region as shaped abrasive particle transfer roll 1022 rotates. The vacuum source or region can have movable dividers to direct it to a specific region or arc segment of shaped abrasive particle transfer roll 1022. The vacuum can suck shaped abrasive particles 992 firmly into cavities 1020 as the production tooling 1000 wraps shaped abrasive particle transfer roll 1022 before subjecting shaped abrasive particles 992 to the pressurized region of shaped abrasive particle transfer roll 1022. This vacuum region be used, for example, with shaped abrasive particle removal member to remove excess shaped abrasive particles 992 from dispensing surface 1012 or may be used to simply ensure shaped abrasive particles 992 do not leave cavities 1020 before reaching a specific position along the outer circumference of the shaped abrasive particle transfer roll 1022.

After separating from shaped abrasive particle transfer roll 1022, production tooling 1000 travels along first web path 999 back towards the shaped abrasive particle filling and excess removal section of the apparatus with the assistance of idler rolls 1016 as necessary. An optional production tool cleaner can be provided to remove stuck shaped abrasive particles still residing in cavities 1020 and/or to remove binding agent 508 transferred to dispensing surface 1012. Choice of the production tool cleaner can depend on the configuration of the production tooling and could be either alone or in combination, an additional air blast, solvent or water spray, solvent or water bath, an ultrasonic horn, or an idler roll the production tooling wraps to use push assist to force shaped abrasive particles 992 out of the cavities 1020. Thereafter endless production tooling 1020 or belt advances to a shaped abrasive particle filling and excess removal section to be filled with new shaped abrasive particles 992.

Various idler rolls 1016 can be used to guide the shaped abrasive particle coated substrate 1014 having a predetermined, reproducible, non-random pattern of shaped abrasive particles 992 on the first major surface that were applied by shaped abrasive particle transfer roll 1022 and held onto the first major surface by the make coat resin along second web path 1032 into an oven for curing the make coat resin. Optionally, a second shaped abrasive particle coater can be provided to place additional abrasive particles, such as another type of abrasive particle or diluents, onto the make coat resin prior to entry in an oven. The second abrasive particle coater can be a drop coater, spray coater, or an electrostatic coater as known to those of skill in the art. Thereafter a cured backing with shaped abrasive particles 992 can enter an optional festoon along second web path 1032 prior to further processing such as the addition of a size coat, curing of the size coat, and other processing steps known to those of skill in the art of making coated abrasive articles.

Although maker 990 is shown as including production tool 1000 as a belt, it is possible in some alternative embodiments for maker 990 to include production tool 1000 on vacuum pull roll 1022. For example, vacuum pull roll 1022 may include a plurality of cavities 1020 to which shaped abrasive particles 992 are directly fed. Shaped abrasive particles 992 can be selectively held in place with a vacuum, which can be disengaged to release shaped abrasive particles 992 on substrate 506. Further details on maker 990 and suitable alternative may be found at US 2016/0315081, to 3M Company, St. Paul MN, the contents of which are hereby incorporated by reference.

Figure 11:
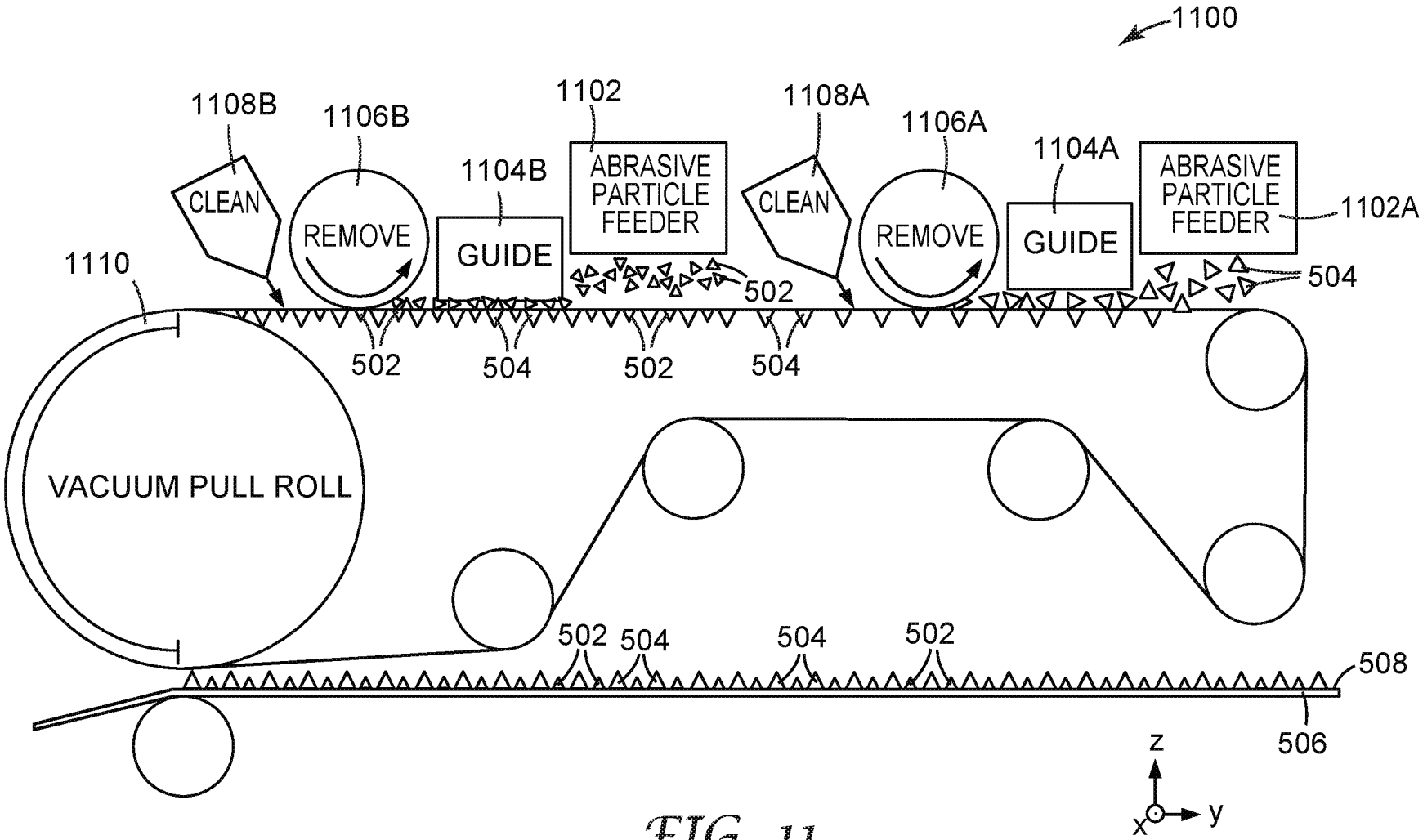
FIG. 11 illustrates, by way of example, a diagram of an embodiment of a system for making an abrasive article with shaped abrasive particles of different sizes or shapes.

FIG. 11 illustrates, by way of example, a diagram of an embodiment of a system 1100 for making an abrasive article with shaped abrasive particles 502, 504 of different sizes or shapes. The system 1100 as illustrated includes abrasive particle feeders 1102A, 1102B, particle organizers 1104A, 1104B, particle removers 1106A, 1106B, and cleaners 1108A, 1108B. The abrasive particle feeders 1102A, 1102B guide shaped abrasive particles 504, 502, respectively to a holding device 1112. The abrasive particle feeders 1102A, 1102B can include a hopper, funnel, or the like, to guide the shaped abrasive particles 504, 502 to the holding device 1112.

The particle organizers 1104A, 1104B separate the shaped abrasive particles 504, 502 and guide them to a cavity (see FIGS. 10-16, among others) in the holding device 1112. The particle organizers 1104A, 1104B can include a brush or the like. The particle organizers 1104A, 1104B can include bristles, rods, columns, or the like. The bristles, rods, columns, or the like can be situated in voids between cavities in the holding device 1112, such as to push or guide the shaped abrasive particles 504, 502 to the cavity.

The particle remover 1106A, 1106B removes shaped abrasive particles 504, 502 that have not made into a cavity, are not properly situated in a cavity, or are situated in an improper cavity. A shaped abrasive particle 504, 502 can be symmetrical or non-symmetrical. For example, a symmetrical shaped abrasive particle can include an equilateral triangle. Non-symmetrical shaped abrasive particles include other shapes.

Figure 12:
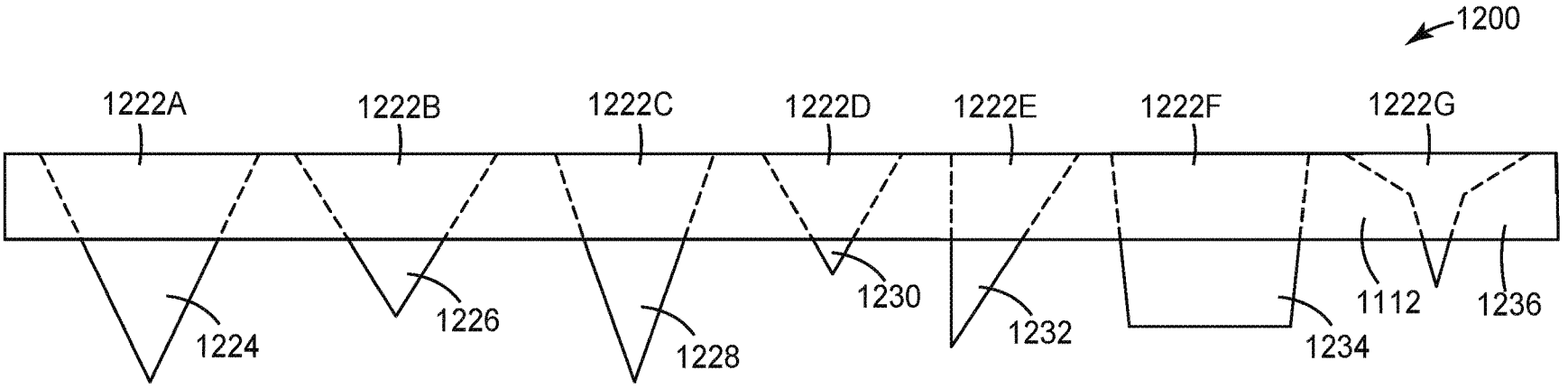
FIGS. 12 illustrates, by way of example, a diagram of an embodiment of shaped abrasive particles situated properly in respective cavities.

FIGS. 12 illustrates, by way of example, a diagram of an embodiment of shaped abrasive particles 1224, 1226, 1228, 1230, 1232, 1234, and 1236 situated properly in respective cavities 1222A, 1222B, 1222C, 1222D, 1222E, 1222F, and 1222G. The shaped abrasive particles 1224, 1226, 1228, 1230, 1232, 1234, and 1236 include differing lengths, widths, heights, or shapes. There is a corresponding cavity 1222A-1222G in which the shaped abrasive particles 1224, 1226, 1228, 1230, 1232, 1234, and 1236 properly fit, respectively. If one of the shaped abrasive particles 1224, 1226, 1228, 1230, 1232, 1234, and 1236 falls into a cavity that is not configured for the shaped abrasive particle 1224, 1226, 1228, 1230, 1232, 1234, and 1236, or if the shaped abrasive particle 1224, 1226, 1228, 1230, 1232, 1234, and 1236 is not an equilateral triangle and falls into the cavity in a wrong orientation, the shaped abrasive particle 1224, 1226, 1228, 1230, 1232, 1234, and 1236 can extend too far beyond a surface 1138 of the holding device 1112 or fall through the cavity. A shaped abrasive particle 1224, 1226, 1228, 1230, 1232, 1234, and 1236 extending too far beyond the surface 1138 can cause problems with downstream processes to adhere the shaped abrasive particles 1224, 1226, 1228, 1230, 1232, 1234, and 1236 to the substrate 506. The cavities 1222A-1222G can be at least partially triangular (be shaped like a portion of a triangle), partially pyramidal, trapezoidal, or other shape.

Figure 13:
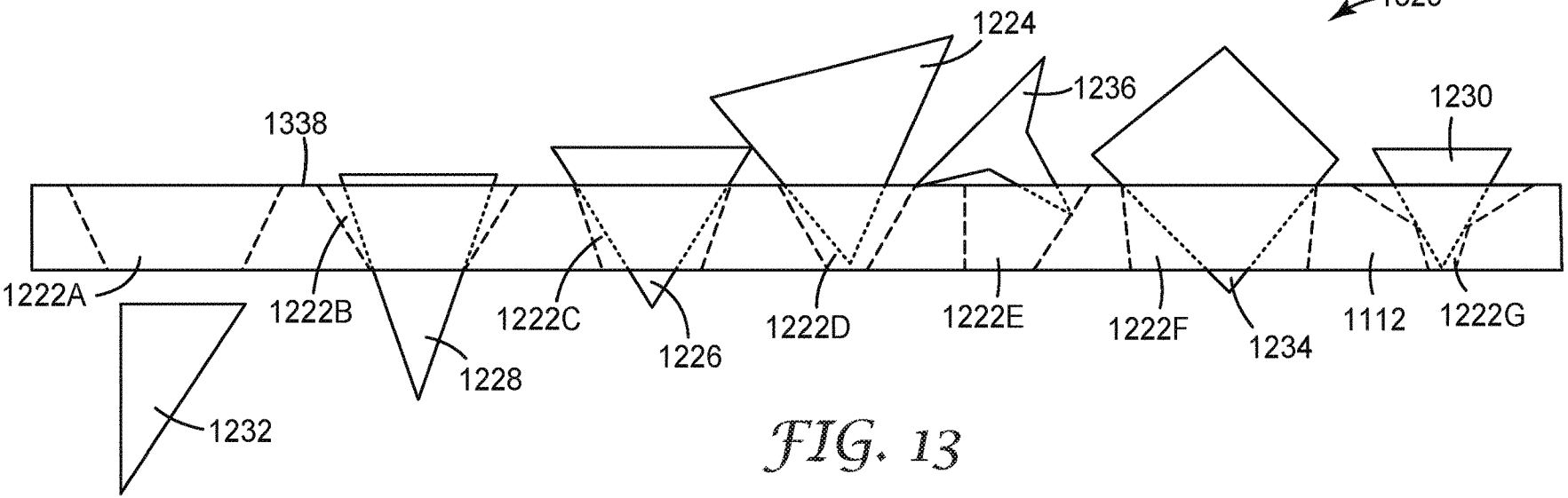
FIG. 13 illustrates, by way of example, a diagram of an embodiment of the shaped abrasive particles situated improperly in respective cavities.
Figure 14:
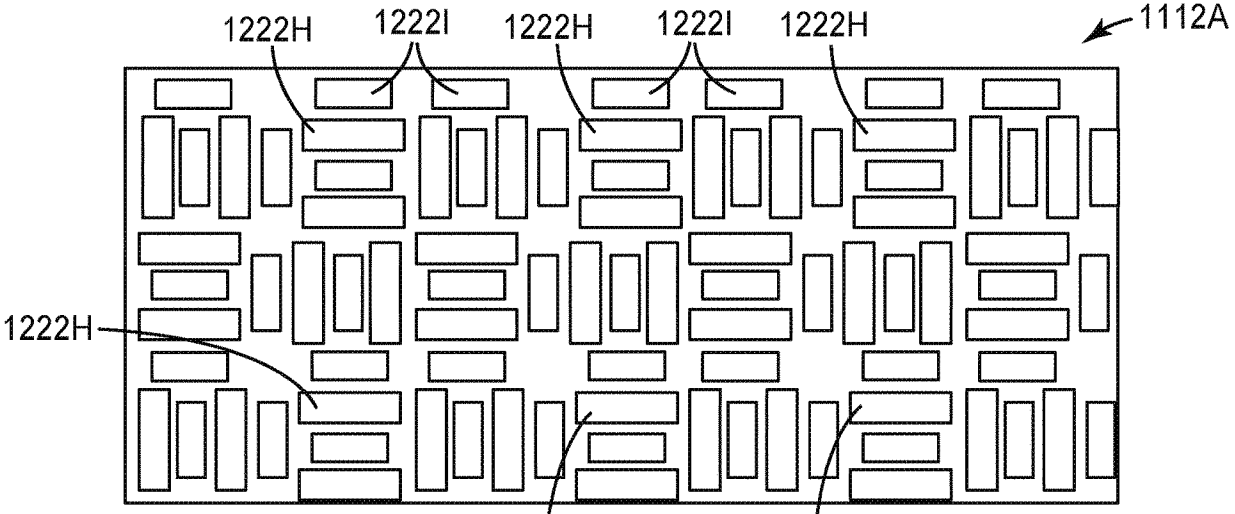
FIGS. 14, 15, 16, and 17 illustrate, by way of example, diagram of respective embodiments of holding tools.
Figure 16:
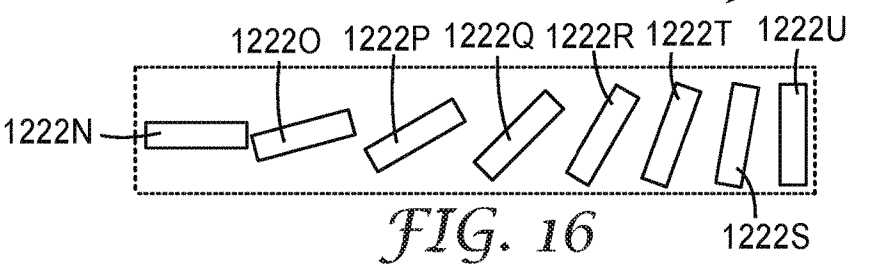
Figure 17:
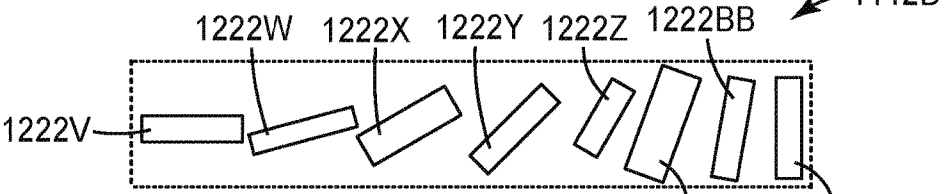
Figure 15:
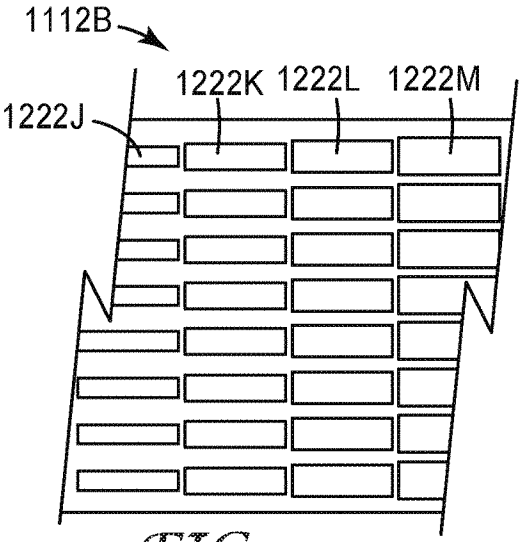

FIG. 13 illustrates, by way of example, a diagram of an embodiment of the shaped abrasive particles 1224, 1226, 1228, 1230, 1232, 1234, and 1236 situated improperly in respective cavities 1222A, 1222B, 1222C, 1222D, 1222E, 1222F, and 1222G. In FIG. 13, the shaped abrasive particle 1232 has fallen through the cavity 1222A, the shaped abrasive particles 1226, 1228, and 1230 are oriented properly in the wrong cavity 1222B, 1222C, and 1222G, respectively, the shaped abrasive particles 1224 and 1236 are oriented improperly in the wrong cavities 1222D and 1222E, and the shaped abrasive particle 1234 is oriented improperly in the proper cavity 1222F.

The particle organizers 1104A, 1104B can help guide the shape abrasive particles 504, 502 to the proper cavities in the holding device 1112. The particle removers 1106A, 1106B can help remove shaped abrasive particles 504, 502 that extend too far beyond the surface 1138 (extend beyond the surface 1138 by over a threshold distance). The cleaner 1108A, 1108B can remove shaped abrasive particles 504, 502 or debris left on or in the holding device 1112. The cleaner 1108A, 1108B can project a fluid at the surface 1138 (see FIG. 11) of the holding device 1112. The fluid can include a liquid, gas, or a combination thereof.

The larger shaped abrasive particles 504 cannot fit properly in the cavities for the smaller shaped abrasive particles, and the smaller shaped abrasive particles can fall into a cavity for a larger shaped abrasive particle and block a larger shaped abrasive particle from falling into a proper cavity. To help ensure that the shaped abrasive particles do not fall through the cavities or a smaller shaped abrasive particle is not situated in a cavity configured for a larger shaped abrasive particle, larger shaped abrasive particles 504 can be provided first. Then a next largest shaped abrasive particle can be provided, such as through another shaped abrasive particle feeder, and so on. In this manner, the cavities 1222 of the holding device 1112 can be filled properly.

Referring to FIG. 11, the vacuum pull roll 1110 can forward the holding device, while vacuum-suctioning the shaped abrasive particles 502, 504 into the cavities. The vacuum-suctioning can retain the shaped abrasive particles 502, 504 into the cavities. The vacuum pull roll 1110 can provide the suction at only a portion thereof. In the example of FIG. 11, the suction is provided in only a hemisphere of the vacuum pull roll 1110. The vacuum pull roll 1110 can rotate the holding device 1112, under suction, until the holding device 1112 is flipped upside down. At this point, the suction can be released. The release of suction can cause the shaped abrasive particle 502, 504 to be released from the holding device 1112. The shaped abrasive particles 502, 504 can be released onto a substrate 506 coated with binding agent 508. The binding agent 508 can be cured to attach the shaped abrasive particles 502, 504 to the substrate 506.

FIGS. 14, 15, 16, and 17 illustrate, by way of example, diagram of respective embodiments of holding tools 1112A, 1112B, 1112C, and 1112D. The holding tools 1112A, 1112B, 1112C, and 1112D are configured to help make the abrasive articles 500, 600, 700, and 800, respectively. The holding tools 1112A-1112D include cavities 1222 with varying widths, lengths, or depths, sometimes called characteristics. The variety of characteristics can accommodate or otherwise be configured to hold shaped abrasive particles of similar, slightly smaller, corresponding characteristics. The holding tool 1112A includes cavities 1222H configured to receive shaped abrasive particles 504 and cavities 1222I configured to receive shaped abrasive particles 502. The holding tool 1112B includes cavities 1222J, 1222K, 1222L, and 1222M configured to receive shaped abrasive particles 602, 604, 606, and 608, respectively. The holding tool 1112C includes cavities 1022N, 1022O, 1022P, 1022Q, 1022R, 1022S, 1022T, and 1022U configured to receive any of the shaped abrasive particles 702, 704, 706, 708, 710, 712, 714, and 716 since the cavities 1222N-1222U and the shaped abrasive particles 702, 704, 706, 708, 710, 712, 714, and 716 include the same or substantially the same respective characteristics. The holding tool 1112D includes cavities 1222V, 1222W, 1222X, 1222Y, 1222Z, 1222AA, 1222BB, and 1222CC configured to receive the shaped abrasive particles 802, 804, 806, 808, 810, 812, 814, and 816, respectively.

As previously discussed, shaped abrasive particles can vary in other characteristics beyond shape and size. For example, shaped abrasive particles can include different hardness, such as by including different materials or by being fired or otherwise formed for a different amount of time or using a different method. In another example, some shaped abrasive particles can be configured to break on contact, while others can be configured to grind on contact. To situate these different shaped abrasive particles in predetermined locations, the different shaped abrasive particles can include corresponding different respective size characteristics as well. Then the shaped abrasive particles can be processed, such as by the system 1100 of FIG. 11, for example, to situate the shaped abrasive particles in their respective locations.

In some embodiments, however, manufacturing tooling to situate the different shaped abrasive particles in specific locations on a substrate can be cost prohibitive, time prohibitive, or unnecessary. In some embodiments, a random distribution of different shaped abrasive particles will be sufficient to achieve a specific grinding profile. In such embodiments, the different shaped abrasive particles can have substantially the same size and shape. These different shaped abrasive particles can be loaded together in an abrasive particle feeder. The provisioning of the different shaped abrasive particles to the holding device 1112 can randomize the locations of the corresponding different shaped abrasive particles. The ratio of different particles to each other in the final abrasive article can be controlled, at least in part, by the distribution of different shaped abrasive particles provided to the abrasive particles feeder.

Figure 18:
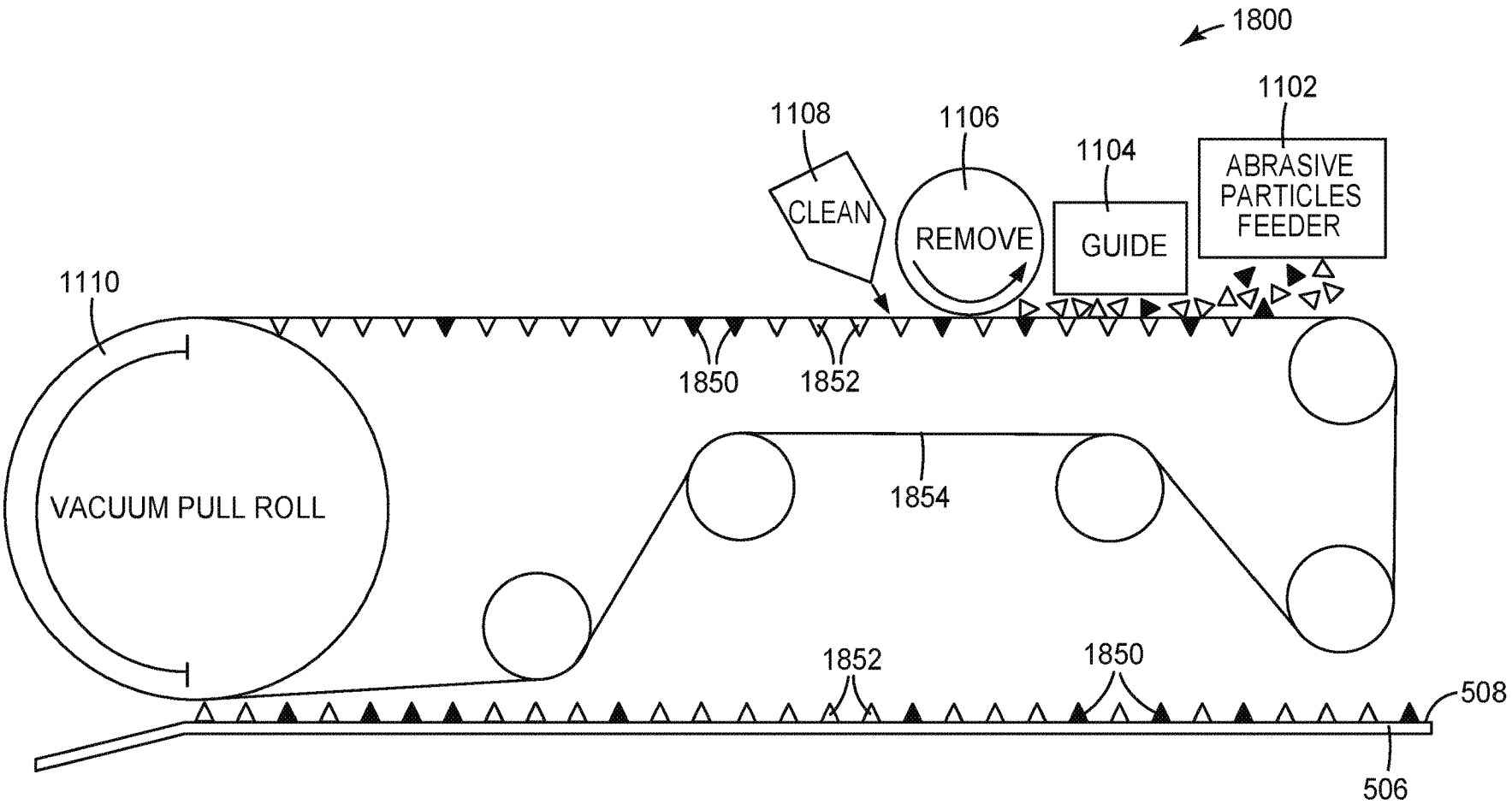
FIG. 18 illustrates, by way of example, a diagram of an embodiment of a system for making an abrasive article with shaped abrasive particles and of same size and shape, but different other characteristics.

FIG. 18 illustrates, by way of example, a diagram of an embodiment of a system 1800 for making an abrasive article with shaped abrasive particles 1850 and 1852 of same size and shape, but different other characteristics. The shaped abrasive particles 1850 can have a different hardness, material, makeup, hollowness, or other characteristic than the shaped abrasive particles 1852. The abrasive particle feeder 1102 guides the shaped abrasive particles 1850 and 1852 to the holding device 1854. The particle guider 1104 pushes the shaped abrasive particles 1850, 1852 to cavities in the holding device 1854. The remover 1106 removes shaped abrasive particles 1850 and 1852 that are not properly situated in a respective cavity of the holding device 1854. The remainder of the system 1800 operates similar to the system 1100 to generate an abrasive article with shaped abrasive particles 1850, 1852 of different characteristics. The ratio of shaped abrasive particles 1850 to shaped abrasive particles 1852 in the abrasive article can be configured to provide a specified pressure or other grinding characteristic.

Figure 19:
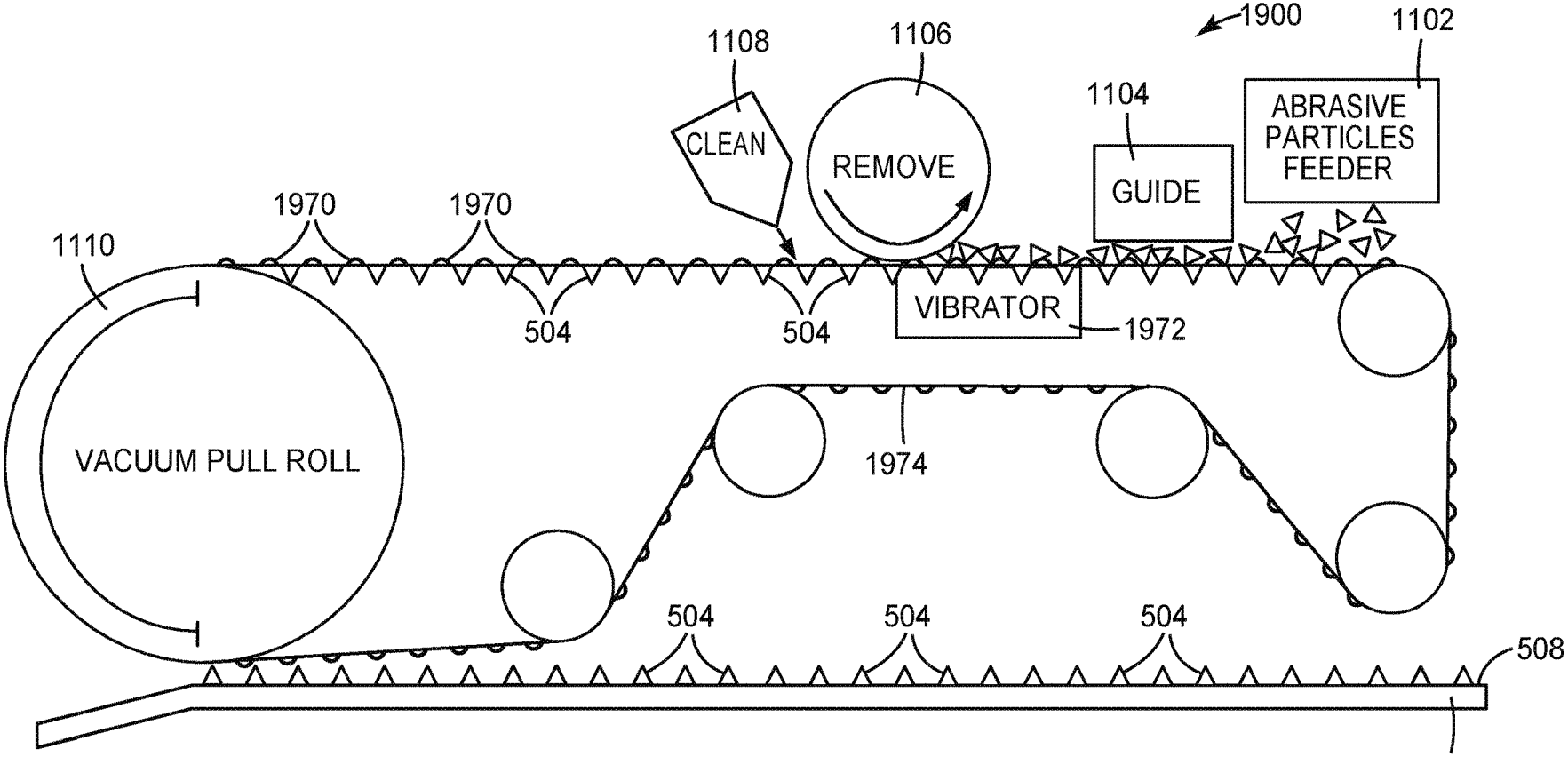
FIG. 19 illustrates, by way of example, a diagram of another embodiment of a system for making an abrasive article.

FIG. 19 illustrates, by way of example, a diagram of another embodiment of a system 1900 for making an abrasive article. The system 1900 is similar to the system 1800, with the system 1900 including a vibrator 1972 and protrusions 1970 extending from a surface of a holding device 1974. The vibrator 1972 can shake the holding device 1974 and promote the abrasive particles 504 falling into a cavity of the holding device 1974. The vibrator 1972 can include a mechanical vibrator, such as a motor, an audio vibrator, such as a speaker, or the like.

The protrusion 1970 can be situated at respective voids in the surface of the holding device 1974. A void is a location on the surface that is not part of a cavity. The protrusion 1970 can include a conical, cylindrical, parabolic, hemispherical, semi elliptical, or other shape. The protrusion 1970 can promote movement of the shaped abrasive particles 504 to respective cavities. For example, if a shaped abrasive particle 504 lands in a flat void, the shaped abrasive particle 504 can tend to stay in the void. With the protrusion 1970 in the void, the shaped abrasive particle 504 can contact the protrusion 1970 and be directed towards a cavity.

FIG. 20 illustrates, by way of example a diagram of an embodiment of the holding device 1974. The holding device 1974 as illustrated includes cavities 1222 and protrusions 1970. The protrusions 1970 are situated in locations between the cavities 1222. The protrusions 1970 extend away from a surface 2080 of a substrate 2082 of the holding device 1974.

The cavities 1222 extend from the surface 2080 in a direction opposite which the protrusions 1970 extend from the surface 2080. The distance the cavities 1222 extend away from the surface 2080 is sometimes called a depth.

The shaped abrasive particles 504, after contacting a protrusion 1970 can move towards the cavity 1222. The protrusion 1970 can include a sloped surface that helps guide the shaped abrasive particle 504 in a specified direction. For example, the protrusion can be conical (as shown in FIG. 21), parabolic (as shown in FIG. 22), hemispherical (as shown in FIG. 23), semi-elliptical (as shown in FIG. 24), cylindrical (as shown in FIG. 25), pyramidal (as shown in FIG. 26) or other shape. A goal of the protrusion 1970 can be to reduce an amount of space that the shaped abrasive particle 504 can rest on the surface 2080 of the substrate 2082 without being in the cavity 1222.

FIGS. 21, 22, 23, 24, 25, and 26 illustrate, by way of example, diagrams of respective embodiments of protrusions 1970 of different shapes. FIG. 21 illustrates a conical protrusion 1970A. FIG. 22 illustrates a parabolic protrusion 1970B. FIG. 23 illustrates a hemispherical protrusion 1970C. FIG. 24 illustrates a semi-hemispherical protrusion 1970D. FIG. 25 illustrates a cylindrical protrusion 1970E. FIG. 26 illustrates a pyramidal protrusion 1970F. Other shapes can be used, such as to help consume space between cavities and promote shaped abrasive article migration to the cavity 1222.

Figure 27:
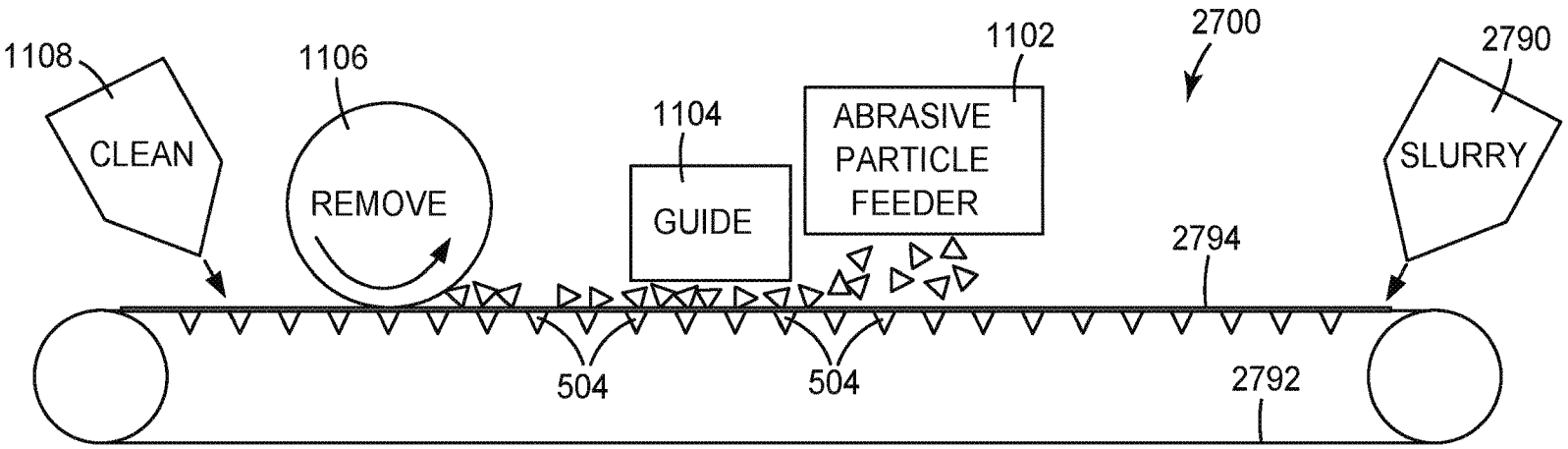
FIG. 27 illustrates, by way of example, a diagram of an embodiment of a system for promoting shaped abrasive particle migration into a cavity (see FIG. 30) of a holding device.

FIG. 27 illustrates, by way of example, a diagram of an embodiment of a system 2700 for promoting shaped abrasive particle migration into a cavity 3010 (see FIG. 30) of a holding device 2792. The system 2700 includes the abrasive particle feeder 1102, the guide 1104, the remover 1106, and the cleaner 1108. The system 2700 includes an optional liquid feeder 2790 that coats the holding device 2792 with an optional slurry 2794, such as water, a co-solvent, a wetting agent, a combination thereof, or the like. The slurry 2794 can help promote shaped abrasive particle migration into a cavity 3010. A cavity 3010 coated with slurry 2794 can have a greater retention force than a dry cavity. For example, the cavity 3010 with the slurry 2794 can retain the shaped abrasive particle 504 in the cavity 3010 even when the holding device 2792 is oriented with the cavity 3010 facing the ground (flipped upside down from the orientation of the holding device 2792).

In some embodiments, the holding device 2792 can be passed under the abrasive particle feeder 1102. The holding device 2792 can then be processed by one or more of the guider 1104, the remover 1106, and the cleaner 1108. The holding device 2792 can then be analyzed, such as by human eye, a camera, or other vision system to determine about how many of the cavities 3010 have abrasive particles 504 situated therein. If there are sufficient abrasive particles 504, the holding device 2792 can be passed for further processing. If there are insufficient abrasive particles 504, the holding device 2792 can be passed back under the abrasive particle feeder 1102 another time. The holding device 2792 can then be processed by one or more of the guider 1104, the remover 1106, and the cleaner 1108 and re-analyzed. This process can repeat until a sufficient number of the cavities 3010 include a shaped abrasive particle 504 therein.

Figure 28:
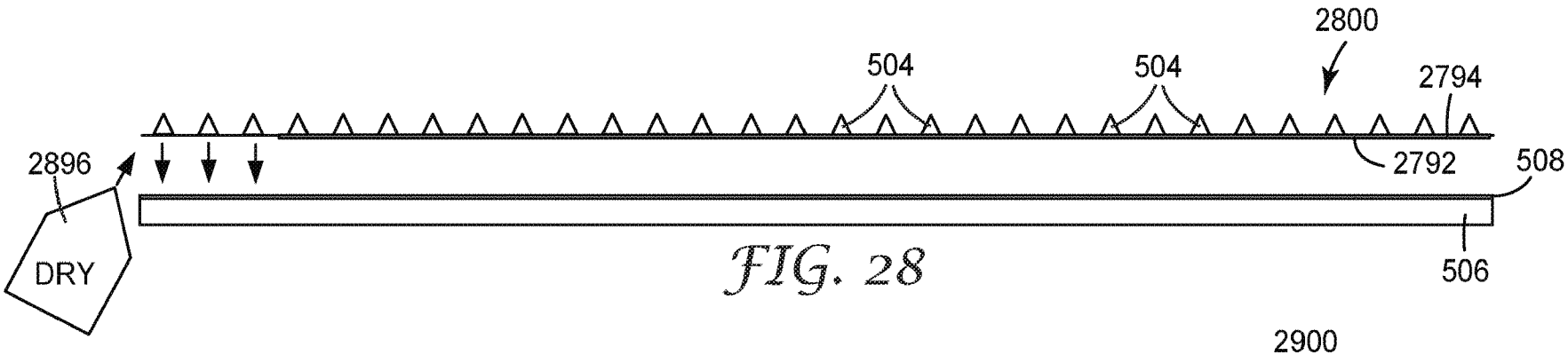
FIG. 28 illustrates, by way of example, a diagram of an embodiment of a system for adhering the shaped abrasive particles in the holding device to the substrate.
Figure 29:
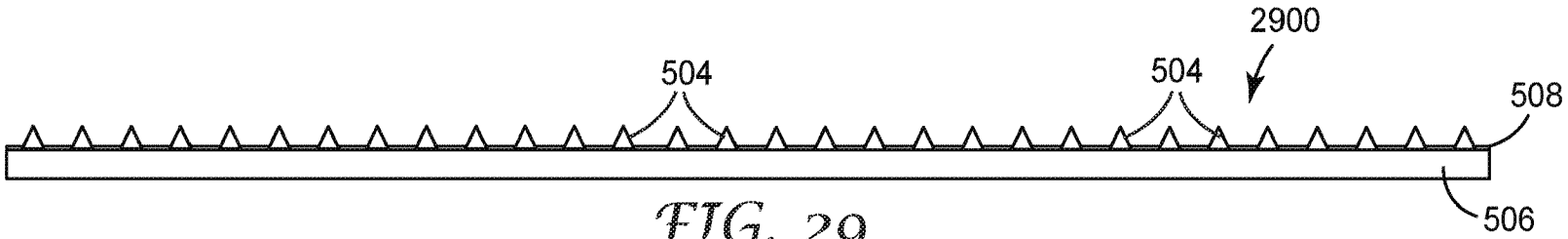
FIG. 29 illustrates, by way of example, a diagram of an embodiment of an abrasive article formed after releasing the shaped abrasive particles 504.

FIG. 28 illustrates, by way of example, a diagram of an embodiment of a system 2800 for adhering the shaped abrasive particles 504 in the holding device 2792 to the substrate 506. The system 2800 includes the holding device 2792 oriented with openings of cavities 3010 (see FIG. 30) facing the substrate 506. A dryer 2896 can evaporate the slurry 2794 from the cavity 3010, such as to release the shaped abrasive particle 504 from the cavity 3010. The shaped abrasive particles 504 can fall to the binding agent 508 and become adhered to the substrate 506. FIG. 29 illustrates, by way of example, a diagram of an embodiment of an abrasive article 2900 formed after releasing the shaped abrasive particles 504.

Figure 30:
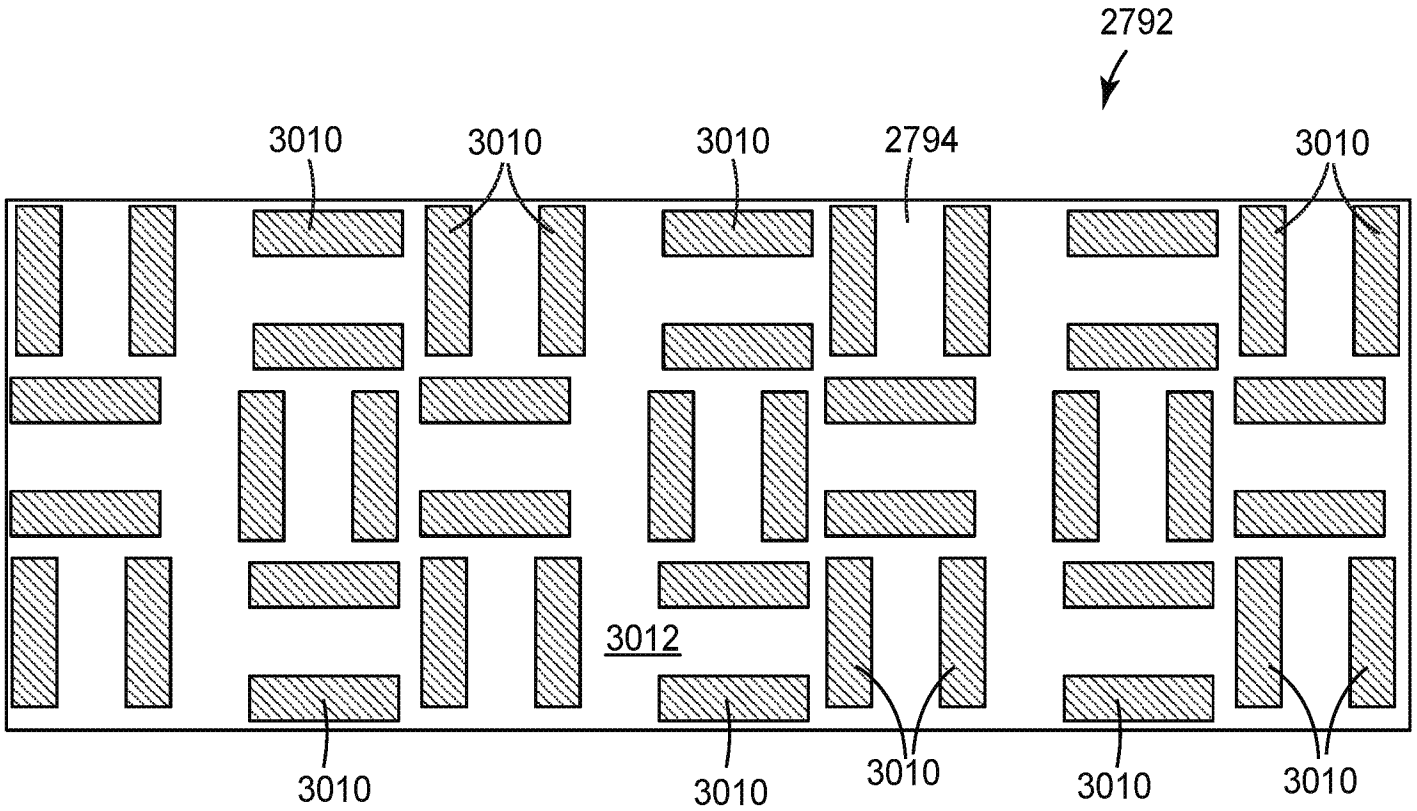
FIG. 30 illustrates, by way of example, a diagram of a holding device.

FIG. 30 illustrates, by way of example, a diagram of the holding device 2792. The holding device 2792 as illustrated includes cavities 3010 to receive shaped abrasive particles 504. The cavities 3010 include the slurry 2794 therein. A surface 3012 of the holding device 2792 can be at least partially coated with the slurry 2794. One or more of the cavities 3010 and the surface 3012 of the holding device 2792, in one or more embodiments, can include a hydrophilic coating. The hydrophilic coating can bond with water, such as water of the slurry 2794. The hydrophilic coating can include a polymer with an oxygen-plasma coating.

Figure 31:
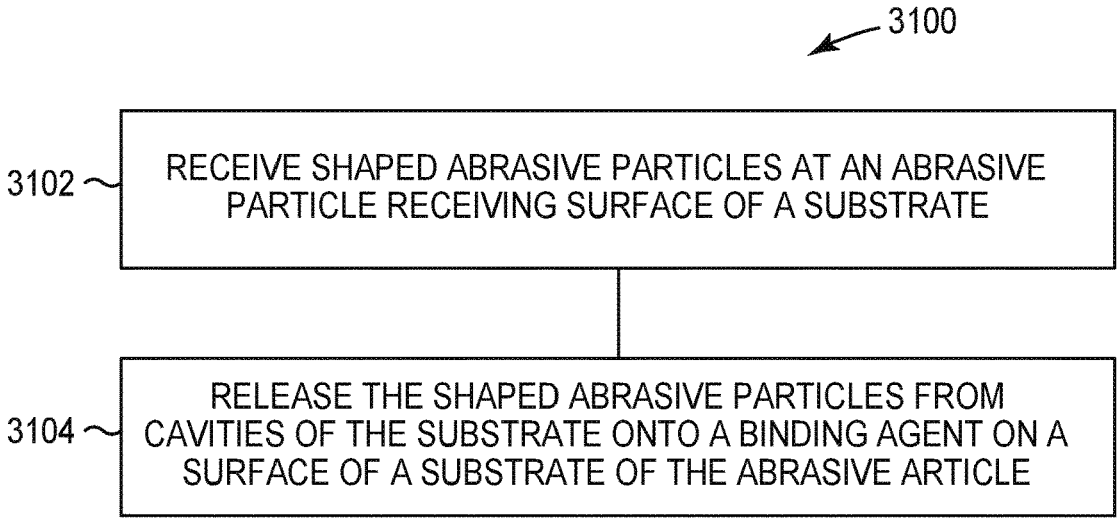
FIG. 31 illustrates, by way of example, a diagram of an embodiment of a method of making an abrasive article.

FIG. 31 illustrates, by way of example, a diagram of an embodiment of a method 3100 of making an abrasive article. The method 3100 as illustrated includes receiving shaped abrasive particles at an abrasive particle receiving surface of a substrate, at operation 3102; and releasing the shaped abrasive particles from cavities of the substrate onto a binding agent on a surface of a substrate of the abrasive article, at operation 3104. The abrasive particle receiving surface 1012 can define an x-y plane including an x-axis and a y-axis and a back surface opposite the abrasive article receiving surface, cavities formed in the substrate, the cavities including one or more sidewalls, the cavities including a width and length at the abrasive article receiving surface, and a depth defined by a distance the cavities extend from the abrasive article receiving surface towards the back surface in a direction parallel to a z-axis perpendicular to the x-y plane.

The method 3100 can further include guiding, by one or more protrusions between proximate cavities of the cavities, a shaped abrasive particle of the shaped abrasive particles to a cavity of the cavities. The method 3100 can further include, wherein the respective protrusions comprise a conical shape, a cylindrical shape, a rectilinear shape, a polygonal shape, or an irregular shape. The method 3100 can further include depositing a fluid, solid, or a combination thereof on the abrasive particle receiving surface before receiving the shaped abrasive particles. The method 3100 can further include, wherein the cavities include a hydrophilic surface. The method 3100 can further include, wherein the abrasive particle receiving surface is hydrophilic.

Figure 32:
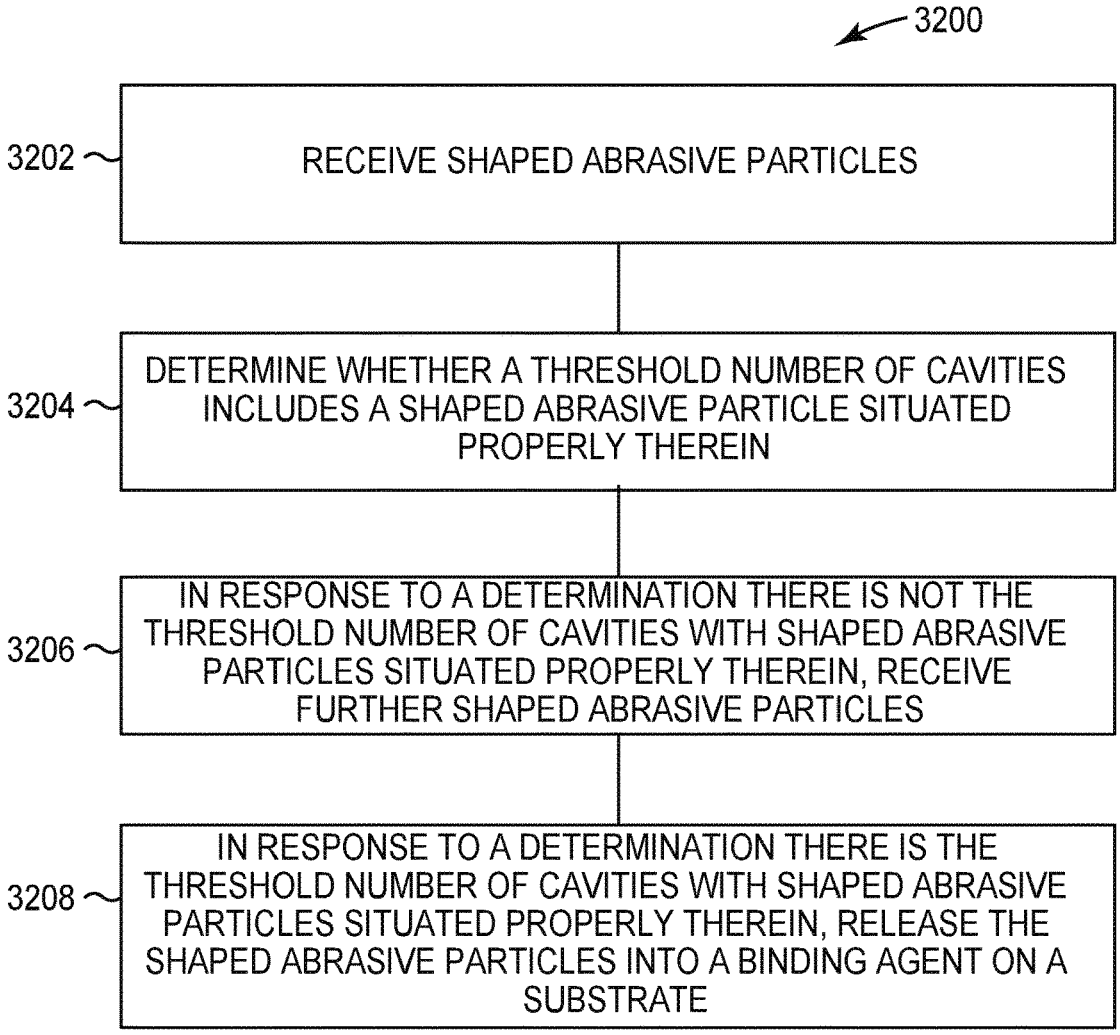
FIG. 32 illustrates, by way of example, a diagram of an embodiment of another method for making an abrasive article.

FIG. 32 illustrates, by way of example, a diagram of an embodiment of another method 3200 for making an abrasive article. The method 3200 as illustrated includes receiving, at a shaped abrasive particle placement tool comprising cavities, shaped abrasive particles, at operation 3202; determining whether a threshold number of cavities of the cavities includes a shaped abrasive particle of the shaped abrasive particles situated properly therein, at operation 3204; in response to determining there is not a threshold number of cavities of the cavities with a shaped abrasive particle of the shaped abrasive particles situated properly therein, receiving, at the shaped abrasive particle placement tool, further shaped abrasive particles, at operation 3206; and in response to determining that at least the threshold number of cavities of the cavities includes a shaped abrasive particle of the shaped abrasive particles situated properly therein, releasing the shaped abrasive particles from the shaped abrasive particle placement tool into at least one binding material on a substrate to adhere the first shaped abrasive particles and the second shaped abrasive particles to the substrate, at operation 3208.

The method 3200 can further include, after receiving the shaped abrasive particles removing, from shaped abrasive particle placement tool, at least one of the received shaped abrasive particles improperly situated in a cavity of the cavities. The method 3200 can further include, before depositing the shaped abrasive particles into the at least one binding material, removing further shaped abrasive particles that are not in a respective cavity of the cavities off the shaped abrasive particle placement tool. The method 3200 can further include vibrating the shaped abrasive particle placement tool to situate shaped abrasive particles of the shaped abrasive particles into a cavity of the cavities. The method 3200 can further include, wherein releasing the shaped abrasive particles from the shaped abrasive particle placement tool includes vibrating the shaped abrasive particle placement tool.

Figure 33:
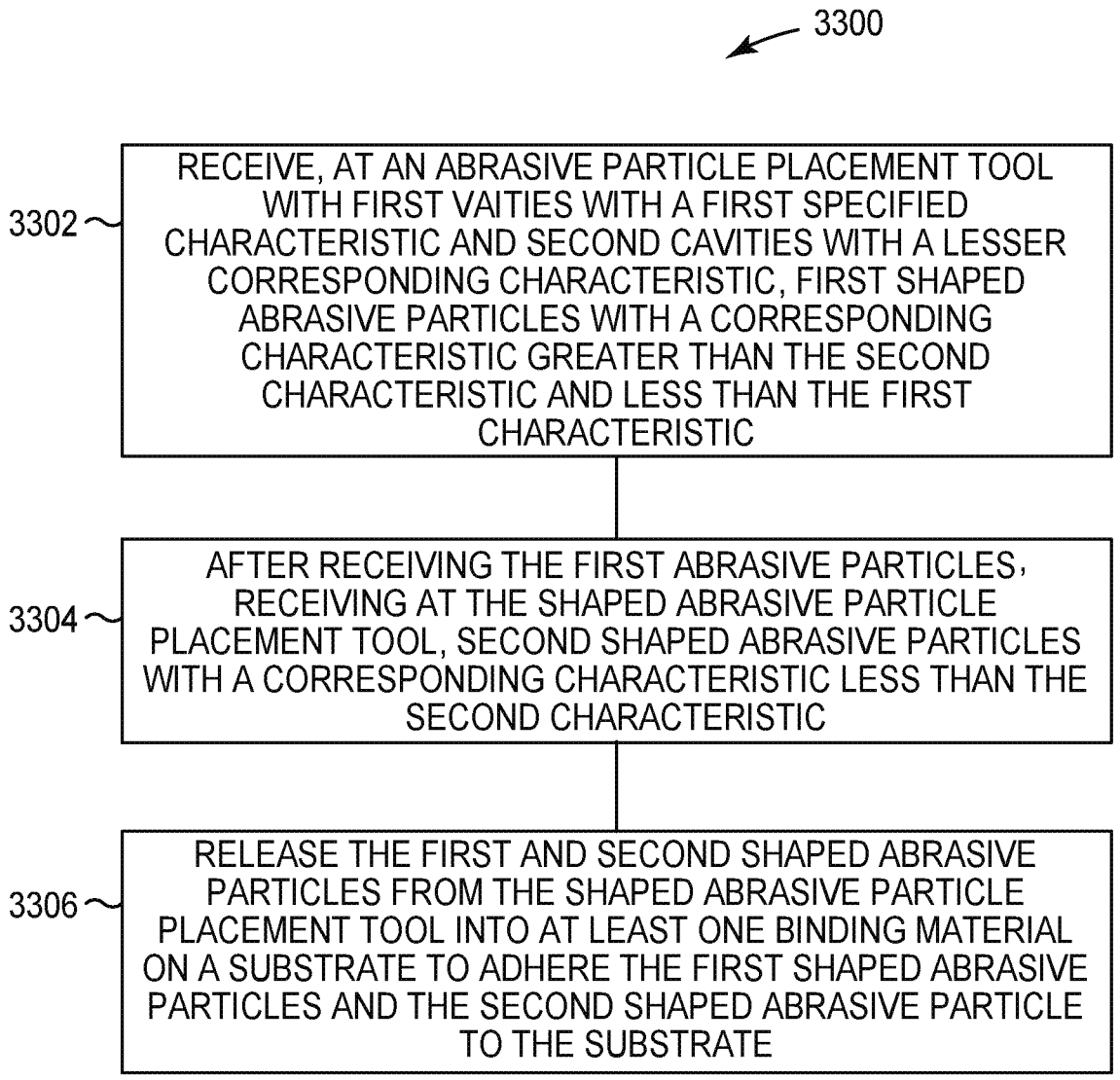
FIG. 33 illustrates, by way of example, a diagram of yet another embodiment of another method for making an abrasive article.

FIG. 33 illustrates, by way of example, a diagram of yet another embodiment of another method 3300 for making an abrasive article. The method 3300 as illustrated includes receiving, at a shaped abrasive particle placement tool comprising first cavities with a first specified characteristic and second cavities with a lesser corresponding characteristic, first shaped abrasive particles with a corresponding characteristic greater than the second characteristic and less than the first characteristic, at operation 3302; after receiving the first abrasive particles, receiving, at the shaped abrasive particle placement tool, second shaped abrasive particles with a corresponding characteristic less than the second characteristic, at operation 3304; and releasing the shaped abrasive particles from the shaped abrasive particle placement tool into at least one binding material on a substrate to adhere the first shaped abrasive particles and the second shaped abrasive particles to the substrate, at operation 3306.

The method 3300 can further include before receiving the second shaped abrasive particles and after receiving the first shaped abrasive particles, removing first shaped abrasive particles that are not in a respective first cavity of the first cavities off the shaped abrasive particle placement tool and receiving further first shaped abrasive particles until a threshold number of the first cavities includes a first shaped abrasive particle situated therein. The method 3300 can further include before depositing the shaped abrasive particle placement tool into the at least one binding material, sweeping or blowing second shaped abrasive particles off that are not in a respective second cavity of the second cavities off the shaped abrasive particle placement tool and receiving further second shaped abrasive particles until a threshold number of the second cavities includes a second shaped abrasive particle situated therein. The method 3300 can further include, wherein the characteristic includes a height, width, or depth.

The method 3300 can further include, wherein the first shaped abrasive particles or the second shaped abrasive particles are not equilateral triangles. The method 3300 can further include vibrating the shaped abrasive particle placement tool to situate a first shaped abrasive particle of the first shaped abrasive particles into a first cavity of the first cavities. The method 3300 can further include, wherein releasing the shaped abrasive particles from the shaped abrasive particle placement tool includes vibrating the shaped abrasive particle placement tool.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present disclosure. Thus, although the present disclosure has been specifically disclosed by specific embodiments and optional features, modification and variation of the concepts herein disclosed may be resorted to by those of ordinary skill in the art, and that such modifications and variations are within the scope of embodiments of the present disclosure.

Additional Embodiments

The following exemplary embodiments are provided, the numbering of which is not to be construed as designating levels of importance:

Example 1 includes an abrasive article comprising a substrate, shaped particles disposed on the substrate, wherein the shaped particles include first shaped abrasive particles and second shaped particles, and wherein a characteristic of the first shaped abrasive particles is different from a corresponding characteristic of the second shaped particles, and at least one binding agent securing the shaped particles to the substrate.

In Example 2, Example 1 further includes, wherein the second shaped particles are grinding aids.

In Example 3, at least one of Examples 1-2 further includes, wherein the second shaped particles are second shaped abrasive particles.

In Example 4, at least one of Examples 1-3 further includes, wherein the characteristic includes one or more of a height, width, length, shape, or hardness.

In Example 5, at least one of Examples 1-4 further includes, wherein a majority of the shaped particles are situated in a specified pattern on the substrate.

In Example 6, at least one of Examples 1-5 further includes, wherein each of the first shaped abrasive particles includes at least two triangular major faces connected to each other and separated by three sidewalls, and on a respective basis, one sidewall of at least 90 percent of the first shaped abrasive particles is disposed facing, proximate, and secured to the substrate by the at least one binding agent.

In Example 7, at least one of Examples 1-6 further includes, wherein a shape of the first shaped abrasive particles includes a tetrahedron or a trapezoid.

In Example 8, at least one of Examples 1-7 further includes, wherein the characteristic is surface area of a major surface of the first shaped abrasive particles and the second shaped particles.

In Example 9, at least one of Examples 1-8 further includes, wherein the characteristic is hardness of the first shaped abrasive particles and the second shaped particles.

In Example 10, at least one of Examples 1-9 further includes, wherein the characteristic is a height of the first shaped abrasive particles and the second shaped particles.

In Example 11, at least one of Examples 1-10 further includes, wherein the characteristic is a width of the first shaped abrasive particles and the second shaped particles.

In Example 12, at least one of Examples 1-11 further includes, wherein the characteristic is height and the first shaped abrasive particles and second shaped particles are situated in a non-random sequence on the substrate.

In Example 13, Example 12 further includes, wherein at least one second shaped particle is situated between two nearest first shaped abrasive particles with respective major surfaces within 10 degrees of a parallel with each other.

In Example 14, at least one of Examples 12-13 further includes, wherein the abrasive material includes pods of shaped particles situated with major surfaces within 10 degrees of perpendicular to each nearest pod, each pod comprising a second shaped particle of the second shaped particles situated between two first shaped abrasive particles of the first shaped abrasive particles, and wherein the respective major surfaces of the first shaped abrasive particles and second shaped particles of the pod are within 10 degrees of parallel to each other.

In Example 15, at least one of Examples 12-14 further includes, wherein the abrasive material includes pods of shaped particles situated with major surfaces within 10 degrees of perpendicular to each nearest pod, each pod comprising a second shaped particle of the second shaped particles or first shaped abrasive particles of the first shaped abrasive particles, and wherein the respective major surfaces of the shaped particles of the pod are within 10 degrees of parallel to each other.

In Example 16, at least one of Examples 1-15 further includes, wherein the characteristic includes surface area of a surface facing and secured to the substrate, the shaped abrasive particles further include third shaped abrasive particles, the surface area of the surface of the third shaped abrasive particles greater than the surface area of the surface of the second shaped abrasive particles, which is greater than the surface area of the surface of the first shaped abrasive particles, and the shaped abrasive particles are situated with a second shaped abrasive particle of the second shaped abrasive particles between a first shaped abrasive particle of the first shaped abrasive particles and a third shaped abrasive particle of the third shaped abrasive particles.

In Example 17, at least one of Examples 1-16 further includes, wherein the characteristic includes hardness and the second shaped particles include a grinding aid.

In Example 18, at least one of Examples 1-17 further includes, wherein the characteristic includes hardness and the first shaped abrasive particles include a Moh's hardness lesser than a Moh's hardness of aluminum oxide.

In Example 19, at least one of Examples 1-18 further includes, wherein the characteristic includes hardness and the first shaped abrasive particles and second shaped particles are situated with harder elements configured to contact a surface to be ground before softer elements.

In Example 20, at least one of Examples 1-19 further includes, wherein the characteristic includes aspect ratio indicating a ratio of height an element extends from an axis perpendicular to the major surface of the substrate to a width of the element parallel to the major surface of the substrate.

In Example 21, at least one of Examples 1-20 further includes, wherein the first shaped abrasive particles and the second shaped abrasive particles are situated randomly relative to one another on the substrate.

In Example 22, at least one of Examples 15-21 further includes, wherein the characteristic is hardness and a ratio of the number of first shaped abrasive particles to the number of second shaped abrasive particles is configured to provide a specified pressure profile when in contact with an object to be grinded.

Example 23 includes an abrasive article comprising a substrate, shaped abrasive particles organized on a major surface of the substrate to contact an object in a sequence such that a first particle of the shaped abrasive particles in the sequence removes a specified width and depth of material and a second particle of the shaped abrasive particles in the sequence removes at least one of (1) a larger width of the material than the first particle and (2) a larger depth of the material than the first particle, and at least one binding agent securing the shaped abrasive particles to the substrate.

In Example 24, Example 23 further includes, wherein each of the first shaped abrasive particles and second shaped abrasive particles includes a polygonal, elliptical, or irregular shaped major surface.

In Example 25, at least one of Examples 23-24 further includes, wherein the first particle includes a narrower width than the second particle.

In Example 26, at least one of Examples 23-25 further includes, wherein the first particle includes a smaller height than the second particle.

In Example 27, at least one of Examples 23-26 further includes, wherein the major surface of the substrate defines an x-y plane including an x-axis and a y-axis, wherein the shaped abrasive particles include major faces extending from the major substrate in a z-direction perpendicular to the x-y plane, wherein the faces of different, proximate abrasive particles of the abrasive particles are oriented at different angles relative to the x-axis.

In Example 28, at least one of Examples 23-27 further includes, wherein the first particle is harder than the second particle.

In Example 29, at least one of Examples 23-28 further includes, wherein the abrasive material includes pods of shaped abrasive particles situated with major surfaces within 10 degrees of perpendicular to each nearest pod, each pod comprising shaped abrasive particles of substantially a same orientation, size, and shape, and wherein the respective major surfaces of the shaped abrasive particles of the pod are within 10 degrees of parallel to each other.

In Example 30, at least one of Examples 23-29 further includes third particles adhered to the substrate, the third particles including a grinding aid.

In Example 31, at least one of Examples 23-30 further includes, wherein the sequence of particles includes particles with different hardness and are situated with harder elements configured to contact a surface to be ground before softer elements contact the surface to be ground.

In Example 32, at least one of Examples 23-31 further includes, wherein the sequence of particles includes particles with different aspect ratio of a ratio of height an element extends from an axis perpendicular to the major surface of the substrate to a width of the element parallel to the major surface of the substrate.

Example 33 includes a shaped abrasive particle placement tool comprising a substrate including an abrasive article receiving surface defining an x-y plane including an x-axis and a y-axis and a back surface opposite the abrasive article receiving surface, cavities formed in the substrate, the cavities including one or more sidewalls, the cavities including a width and length at the abrasive article receiving surface, and a depth defined by a distance the first cavities extend from the abrasive article receiving surface towards the back surface, wherein the one or more sidewalls of proximate cavities of the cavities are situated such that corresponding sidewalls of the proximate cavities are oriented at different angles relative to the x-axis, and shaped abrasive particles situated in the cavities.

In Example 34, Example 33 further includes, wherein the cavities include at least two at least partial triangular walls connected to each other and separated by two sidewalls.

In Example 35, at least one of Examples 33-34 further includes, wherein the first cavities include four at least partially triangular walls forming a pyramid or truncated pyramid shape.

In Example 36, at least one of Examples 33-35 further includes, wherein the proximate cavities include a first cavity and a second cavity and the angle of the sidewalls of the first cavity relative to the x-axis is at least ten degrees greater than the angle of the sidewalls of the second cavity relative to the x-axis.

Example 37 includes a shaped abrasive particle placement tool comprising a substrate including an abrasive particle receiving surface defining an x-y plane including an x-axis and a y-axis and a back surface opposite the abrasive particle receiving surface, cavities formed in the substrate, the cavities including one or more sidewalls, the cavities including a width and length at the abrasive article receiving surface, and a depth defined by a distance the first cavities extend from the abrasive article receiving surface towards the back surface in a direction parallel to a z-axis perpendicular to the x-y plane, and respective protrusions between two or more proximate cavities, the respective protrusions extending from the abrasive article receiving surface in a direction parallel to the z-axis and away from the back surface, and shaped abrasive particles situated in the cavities.

In Example 38, Example 37 includes wherein the respective protrusions comprise a hemispherical shape.

In Example 39, at least one of Examples 37-38 further includes, wherein the respective protrusions comprise a conical shape.

In Example 40, at least one of Examples 37-39 further includes, wherein the respective protrusions comprise a cylindrical shape.

In Example 41, at least one of Examples 37-40 further includes, wherein the respective protrusions comprise a rectilinear shape.

In Example 42, at least one of Examples 37-41 further includes, wherein the respective protrusions comprise a polygonal shape.

In Example 43, at least one of Examples 37-42 further includes, wherein the respective protrusions comprise irregular shapes.

In Example 44, at least one of Examples 37-43 further includes, wherein the shaped abrasive particles, include a fluid, solid, or a combination thereof thereon.

In Example 45, at least one of Examples 43-44 further includes, wherein the cavities include a hydrophilic surface.

In Example 46, at least one of Examples 43-45 further includes, wherein the abrasive particle receiving surface is hydrophilic.

Example 47 includes a shaped abrasive particle placement tool comprising a substrate including an abrasive article receiving surface defining an x-y plane including an x-axis and a y-axis and a back surface opposite the abrasive article receiving surface, cavities formed in the substrate, the cavities including one or more sidewalls, the cavities including a width and length at the abrasive article receiving surface, and a depth defined by a distance the cavities extend from the abrasive article receiving surface towards the back surface in a direction parallel to a z-axis perpendicular to the x-y plane, and shaped abrasive particles situated in the cavities, wherein the shaped abrasive particles, include a fluid, solid, or a combination thereof thereon.

In Example 48, Example 47 further includes, wherein the cavities include a hydrophilic surface.

In Example 49, at least one of Examples 47-48 further includes respective protrusions between proximate cavities, the respective protrusions extending from the abrasive article receiving surface in a direction parallel to the z-axis and away from the back surface.

In Example 50, Example 49 further includes, wherein the respective protrusions comprise a hemispherical shape.

In Example 51, at least one of Examples 49-50 further includes, wherein the respective protrusions comprise a conical shape.

In Example 52, at least one of Examples 49-51 further includes, wherein the respective protrusions comprise a cylindrical shape.

In Example 53, at least one of Examples 49-52 further includes, wherein the respective protrusions comprise a rectilinear shape.

In Example 54, at least one of Examples 49-53 further includes, wherein the respective protrusions comprise a polygonal shape.

In Example 55, at least one of Examples 49-54 further includes, wherein the respective protrusions comprise irregular shapes.

In Example 56, at least one of Examples 47-55 further includes, wherein the abrasive particle receiving surface is hydrophilic.

Example 57 includes a method of making an abrasive article, the method comprising receiving shaped abrasive particles at an abrasive particle receiving surface of a substrate, the abrasive particle receiving surface defining an x-y plane including an x-axis and a y-axis and a back surface opposite the abrasive article receiving surface, cavities formed in the substrate, the cavities including one or more sidewalls, the cavities including a width and length at the abrasive article receiving surface, and a depth defined by a distance the cavities extend from the abrasive article receiving surface towards the back surface in a direction parallel to a z-axis perpendicular to the x-y plane, and releasing the shaped abrasive particles from the cavities of the substrate onto a binding agent on a surface of a substrate of the abrasive article.

In Example 58, Example 57 further includes guiding, by one or more protrusions between proximate cavities of the cavities, a shaped abrasive particle of the shaped abrasive particles to a cavity of the cavities.

In Example 59, Example 58 further includes, wherein the respective protrusions comprise a conical shape.

In Example 60, at least one of Examples 58-59 further includes, wherein the respective protrusions comprise a cylindrical shape.

In Example 61, at least one of Examples 58-60 further includes, wherein the respective protrusions comprise a rectilinear shape.

In Example 62, at least one of Examples 58-61 further includes, wherein the respective protrusions comprise a polygonal shape.

In Example 63, at least one of Examples 58-62 further includes, wherein the respective protrusions comprise irregular shapes.

In Example 64, at least one of Examples 57-63 further includes depositing a fluid, solid, or a combination thereof on the abrasive particle receiving surface before receiving the shaped abrasive particles.

In Example 65, Example 64 further includes, wherein the cavities include a hydrophilic surface.

In Example 66, at least one of Examples 64-65 further includes, wherein the abrasive particle receiving surface is hydrophilic.

Example 67 includes a method comprising receiving, at a shaped abrasive particle placement tool comprising cavities, shaped abrasive particles, determining whether a threshold number of cavities of the cavities includes a shaped abrasive particle of the shaped abrasive particles situated properly therein, in response to determining there is not a threshold number of cavities of the cavities with a shaped abrasive particle of the shaped abrasive particles situated properly therein, receiving, at the shaped abrasive particle placement tool, further shaped abrasive particles, and in response to determining that at least the threshold number of cavities of the cavities includes a shaped abrasive particle of the shaped abrasive particles situated properly therein, releasing the shaped abrasive particles from the shaped abrasive particle placement tool into at least one binding material on a substrate to adhere the first shaped abrasive particles and the second shaped abrasive particles to the substrate.

In Example 68, Example 67 further includes after receiving the shaped abrasive particles removing, from shaped abrasive particle placement tool, at least one of the received shaped abrasive particles improperly situated in a cavity of the cavities.

In Example 69, at least one of Examples 67-68 further includes before depositing the shaped abrasive particles into the at least one binding material, removing further shaped abrasive particles that are not in a respective cavity of the cavities off the shaped abrasive particle placement tool.

In Example 70, at least one of Examples 67-69 further includes vibrating the shaped abrasive particle placement tool to situate shaped abrasive particles of the shaped abrasive particles into a cavity of the cavities.

In Example 71, at least one of Examples 67-70 further includes, wherein releasing the shaped abrasive particles from the shaped abrasive particle placement tool includes vibrating the shaped abrasive particle placement tool.

Example 72 includes a method comprising receiving, at a shaped abrasive particle placement tool comprising first cavities with a first specified characteristic and second cavities with a lesser corresponding characteristic, first shaped abrasive particles with a corresponding characteristic greater than the second characteristic and less than the first characteristic, after receiving the first abrasive particles, receiving, at the shaped abrasive particle placement tool, second shaped abrasive particles with a corresponding characteristic less than the second characteristic, and releasing the shaped abrasive particles from the shaped abrasive particle placement tool into at least one binding material on a substrate to adhere the first shaped abrasive particles and the second shaped abrasive particles to the substrate.

In Example 73, Example 72 further includes before receiving the second shaped abrasive particles and after receiving the first shaped abrasive particles, removing first shaped abrasive particles that are not in a respective first cavity of the first cavities off the shaped abrasive particle placement tool and receiving further first shaped abrasive particles until a threshold number of the first cavities includes a first shaped abrasive particle situated therein.

In Example 74, at least one of Examples 72-73 further includes before depositing the shaped abrasive particle placement tool into the at least one binding material, sweeping or blowing second shaped abrasive particles off that are not in a respective second cavity of the second cavities off the shaped abrasive particle placement tool and receiving further second shaped abrasive particles until a threshold number of the second cavities includes a second shaped abrasive particle situated therein.

In Example 75, at least one of Examples 72-74 further includes, wherein the characteristic includes a height, width, or depth.

In Example 76, at least one of Examples 72-75 further includes, wherein the first shaped abrasive particles or the second shaped abrasive particles include major surfaces that are not equilateral triangles.

In Example 77, at least one of Examples 72-76 further includes vibrating the shaped abrasive particle placement tool to situate a first shaped abrasive particle of the first shaped abrasive particles into a first cavity of the first cavities.

In Example 78, at least one of Examples 72-76 further includes, wherein releasing the shaped abrasive particles from the shaped abrasive particle placement tool includes vibrating the shaped abrasive particle placement tool.

Example 79 includes a shaped abrasive particle placement tool comprising a substrate including an abrasive article receiving surface and a back surface opposite the abrasive article receiving surface, cavities formed in the substrate including one or more sidewalls, the cavities including first cavities and second cavities, the first cavities including a first width and first length at the abrasive article receiving surface, and a first depth indicating a distance the first cavities extend from the abrasive article receiving surface towards the back surface, the second cavities including a second width and second length at the abrasive article receiving surface, and a second depth indicating a distance the second cavities extend from the abrasive article receiving surface towards the back surface, wherein one or more of (1) the first width is greater than the second width, (2) the first length is greater than the second length, or (3) the first depth is greater than the second depth, first shaped abrasive particles situated in the first cavities, the first shaped abrasive particles including (1) a width and length less than the first width and first length, respectively, and greater than the second width or second length, respectively, or (2) a height greater than a threshold greater than the second depth and less than the threshold greater than the first depth, and second shaped abrasive particles situated in the second cavities, the second shaped abrasive particles including (1) a width and length less than the second width and the second length, respectively, or (2) a height less than the threshold greater than the second depth.

In Example 80, Example 79 further includes, wherein the first cavities are situated in a non-random orientation relative to one another.

In Example 81, at least one of Examples 79-80 further includes, wherein the first width is greater than the second width or the first length is greater than the second length, the first shaped abrasive particles include a width and length less than the first width and first length, respectively, and greater than the second width or second length, respectively, and the second shaped abrasive particles include a width and length less than the second width and the second length, respectively.

In Example 82, at least one of Examples 79-81 further includes, wherein the first depth is greater than the second depth, the first abrasive articles include a height greater than a threshold greater than the second depth and less than the threshold greater than the first depth, and the second abrasive articles include a height less than the threshold greater than the second depth.

In Example 83, at least one of Examples 79-82 further includes, wherein at least one of the first and second shaped abrasive particles includes a major surface that is a non-equilateral triangle shape.

In Example 84, at least one of Examples 79-83 further includes, wherein the first cavities include at least two at least partial triangular walls connected to each other and separated by two sidewalls.

In Example 85, at least one of Examples 79-84 further includes, wherein the first cavities include four at least partially triangular walls forming a pyramid or truncated pyramid shape.

In Example 86, at least one of Examples 79-85 further includes, wherein the first shaped abrasive particles and the second shaped abrasive particles include a respective different characteristic.

In Example 87, Examples 86 further includes, wherein the characteristic is surface area of a major surface of the first shaped abrasive particles and the second shaped abrasive particles.

In Example 88, at least one of Examples 79-87 further includes, wherein the first cavities and the second cavities include different respective depths and the first cavities and the second cavities are situated in an alternating pattern in the substrate.

In Example 89, Example 88 further includes, wherein at least one second cavity of the second cavities is situated between two nearest first cavities with respective major surfaces within 10 degrees of a parallel with each other.

In Example 90, Example 89 further includes, wherein the cavities include pods of cavities situated with major surfaces within 10 degrees of perpendicular to each nearest pod, each pod comprising a second cavity of the second cavities situated between two first cavities of the first cavities, and wherein the respective major surfaces of the first cavities and second cavity of the pod are within 10 degrees of parallel to each other.

In Example 91, at least one of Examples 86-90 further includes, wherein the cavities further include third cavities, a width of the third cavities is less than the second width which is less than the first width, and the cavities are situated with a second cavity of the second cavities between a first cavity of the first cavity and a third cavity of the third cavities.

In Example 92, at least one of Examples 86-91 further includes, wherein the characteristic includes aspect ratio indicating a ratio of height a shaped abrasive particle extends from an axis perpendicular to the major surface of the substrate to a width of the element parallel to the major surface of the substrate.

In Example 93, at least one of Examples 79-92 further includes, wherein the first cavities and the second cavities are situated randomly relative to one another in the substrate.

What is claimed is:

1. A method comprising:

receiving, at a shaped abrasive particle placement tool comprising first cavities with a first specified characteristic and second cavities with a second lesser corresponding characteristic, first shaped abrasive particles with a corresponding characteristic greater than the second characteristic and less than the first characteristic;

determining whether a threshold number of the first cavities includes a shaped abrasive particle of the first shaped abrasive particles situated properly therein;

in response to determining there is not a threshold number of cavities of the cavities with a shaped abrasive particle of the first shaped abrasive particles situated properly therein, receiving, at the shaped abrasive particle placement tool, further first shaped abrasive particles;

in response to determining that at least the threshold number of cavities of the cavities includes a shaped abrasive particle of the shaped abrasive particles situated properly therein, removing first shaped abrasive particles that are not in a respective first cavity of the first cavities from the shaped abrasive particle placement tool;

receiving, at the shaped abrasive particle placement tool, second shaped abrasive particles with a corresponding characteristic less than the second characteristic;

removing second shaped abrasive particles that are not in a respective second cavity of the second cavities from the shaped abrasive particle placement tool and receiving further second shaped abrasive particles until a threshold number of the second cavities includes a second shaped abrasive particle situated therein; and releasing the shaped abrasive particles from the shaped abrasive particle placement tool into at least one binding material on a substrate to adhere the first shaped abrasive particles and the second shaped abrasive particles to the substrate.

2. The method of claim 1, further comprising after receiving the first shaped abrasive particles, removing, from shaped abrasive particle placement tool, at least one of the received first shaped abrasive particles improperly situated in a cavity of the first cavities.

3. The method of claim 1, further comprising, before releasing the shaped abrasive particles into the at least one binding material, removing further shaped abrasive particles that are not in a respective cavity of the first or second cavities from the shaped abrasive particle placement tool.

4. The method of claim 1, further comprising vibrating the shaped abrasive particle placement tool to situate shaped abrasive particles of the shaped abrasive particles into a cavity of the first or second cavities.

5. The method of claim 1, wherein releasing the shaped abrasive particles from the shaped abrasive particle placement tool includes vibrating the shaped abrasive particle placement tool.

* * * * *